US005709062A

United States Patent [19]

Woolford

[11] Patent Number: 5,709,062

[45] **Date of Patent: *Jan. 20, 1998**

[54] COMPOSITE MASONRY BLOCK

[75] Inventor: Michael E. Woolford, Lake Elmo, Minn.

[73] Assignee: Anchor Wall Systems, Inc., Brooklyn Park, Minn.

[ * ] Notice: The term of this patent shall not extend beyond the expiration date of Pat. No. 5,711,129.

[21] Appl. No.: 680,919

[22] Filed: Jul. 15, 1996

Related U.S. Application Data

[60] Continuation of Ser. No. 434,779, May 4, 1995, which is a division of Ser. No. 130,298, Oct. 1, 1993, abandoned, which is a continuation-in-part of Ser. No. 56,986, May 4, 1993, abandoned, which is a continuation of Ser. No. 957,598, Oct. 6, 1992, abandoned.

[51] Int. Cl.[6] ..... E04C 1/00

[52] U.S. Cl. ..... 52/604; 52/608; 52/611; 52/592.6

[58] Field of Search ..... 52/604, 608, 611, 52/612, 592.6; 405/284, 286

[56] References Cited

U.S. PATENT DOCUMENTS

| | | |
|---|---|---|
| 126,547 | 5/1872 | Hickcox . |
| 228,052 | 5/1880 | Frost . |
| D. 237,704 | 11/1975 | Lane . |
| D. 279,030 | 5/1985 | Risi et al. . |
| D. 280,024 | 8/1985 | Risi et al. . |
| D. 284,109 | 6/1986 | Seal, Jr. . |
| D. 295,788 | 5/1988 | Forsberg . |
| D. 295,790 | 5/1988 | Forsberg . |
| D. 296,007 | 5/1988 | Forsberg . |
| D. 296,365 | 6/1988 | Forsberg . |
| D. 297,464 | 8/1988 | Forsberg . |
| D. 297,574 | 9/1988 | Forsberg . |
| D. 297,767 | 9/1988 | Forsberg . |
| D. 298,463 | 11/1988 | Forsberg . |

(List continued on next page.)

FOREIGN PATENT DOCUMENTS

| | | |
|---|---|---|
| 22397/85 | 6/1985 | Australia . |
| 548 462 | 12/1985 | Australia . |
| B.67477/81 | 12/1985 | Australia . |
| 52765/86 | 8/1986 | Australia . |
| 80775/87 | 4/1988 | Australia . |
| 338139 | 12/1933 | Canada . |
| 531354 | 10/1958 | Canada . |
| 941626 | 2/1974 | Canada . |

(List continued on next page.)

OTHER PUBLICATIONS

Retaining Wall Block Pictures (date unknown).
Columbia Machine Mold Decriptions (date unknown).
Kawano Cement Brochure (date unknown).
*Diamond Block* Test Report to University of Wisconsin, Platteville (1990).

(List continued on next page.)

*Primary Examiner*—Christopher Kent
*Attorney, Agent, or Firm*—Merchant, Gould, Smith, Edell, Welter & Schmidt, P.A.

[57] ABSTRACT

A composite masonry block having a front surface and a back surface which are adjoined by first and second side surfaces, as well as a top surface and a bottom surface each lying adjacent the front, back, and first and second side surfaces. Each of the side surfaces has an inset spanning from the block top surface to the block bottom surface. The block top surface has one or more protrusions positioned adjacent the first and second insets on the block top surface. The blocks have back legs which are directed outwardly from the blocks back surface. The block back legs may extend in a plane parallel to the block front surface or extend forwardly toward the blocks front surface. In use, the blocks may be stacked to provide an interlocking structure wherein the protrusions of one block interfit within the insets of another block. Also included is a method of block molding and a mold assembly which may be used to make a block which may be stackable to form structures of varying setback.

30 Claims, 14 Drawing Sheets

U.S. PATENT DOCUMENTS

| | | |
|---|---|---|
| D. 299,067 | 12/1988 | Forsberg . |
| D. 299,069 | 12/1988 | Risi et al. . |
| D. 300,253 | 3/1989 | Forsberg . |
| D. 300,254 | 3/1989 | Forsberg . |
| D. 301,064 | 5/1989 | Forsberg . |
| D. 311,444 | 10/1990 | Forsberg . |
| D. 316,904 | 5/1991 | Forsberg . |
| D. 317,048 | 5/1991 | Forsberg . |
| D. 317,209 | 5/1991 | Forsberg . |
| 468,838 | 2/1892 | Steiger . |
| 566,924 | 9/1896 | Morrin . |
| 810,748 | 1/1906 | Haller et al. . |
| 831,077 | 9/1906 | Johnson . |
| 847,476 | 3/1907 | Hodges . |
| 884,354 | 4/1908 | Bertrand . |
| 916,756 | 3/1909 | Grant . |
| 1,002,161 | 8/1911 | Lambert . |
| 1,092,621 | 4/1914 | Worner . |
| 1,219,127 | 3/1917 | Marshall . |
| 1,222,061 | 4/1917 | Bartells . |
| 1,248,070 | 11/1917 | Buente . |
| 1,285,458 | 11/1918 | Strunk . |
| 1,287,055 | 12/1918 | Lehman . |
| 1,330,884 | 2/1920 | McDermott . |
| 1,414,444 | 5/1922 | Straight . |
| 1,419,805 | 6/1922 | Bigler . |
| 1,456,498 | 5/1923 | Binns . |
| 1,465,608 | 8/1923 | McCoy . |
| 1,472,917 | 11/1923 | Laird . |
| 1,557,946 | 10/1925 | Smith . |
| 1,695,997 | 12/1928 | Evers et al. . |
| 1,727,363 | 9/1929 | Bone . |
| 1,733,790 | 10/1929 | Gilman . |
| 1,751,028 | 3/1930 | Caswell et al. . |
| 1,773,579 | 8/1930 | Flath . |
| 1,907,053 | 5/1933 | Flath . |
| 1,993,291 | 5/1935 | Vermont . |
| 2,011,531 | 8/1935 | Tranchell . |
| 2,034,851 | 3/1936 | Wichmann . |
| 2,094,167 | 9/1937 | Evers . |
| 2,112,450 | 6/1938 | Sentrop . |
| 2,113,076 | 4/1938 | Bruce . |
| 2,149,957 | 3/1939 | Dawson . |
| 2,197,960 | 4/1940 | Alexander . |
| 2,219,606 | 10/1940 | Schoick . |
| 2,235,646 | 3/1941 | Schaffer . |
| 2,313,363 | 3/1943 | Schmitt . |
| 2,371,201 | 3/1945 | Wells . |
| 2,570,384 | 10/1951 | Russell . |
| 2,882,689 | 4/1959 | Huch et al. . |
| 2,963,828 | 12/1960 | Belliveau . |
| 3,036,407 | 5/1962 | Dixon . |
| 3,204,316 | 9/1965 | Jackson . |
| 3,274,742 | 9/1966 | Paul, Jr. et al. . |
| 3,378,885 | 4/1968 | Dart . |
| 3,390,502 | 7/1968 | Carroll . |
| 3,430,404 | 3/1969 | Muse . |
| 3,488,964 | 1/1970 | Kubo . |
| 3,557,505 | 1/1971 | Kaul . |
| 3,631,682 | 1/1972 | Hilfiker et al. . |
| 3,667,186 | 6/1972 | Kato . |
| 3,754,499 | 8/1973 | Heisman et al. . |
| 3,783,566 | 1/1974 | Nielson . |
| 3,925,994 | 12/1975 | Broms et al. . |
| 3,932,098 | 1/1976 | Huber et al. . |
| 3,936,987 | 2/1976 | Calvin . |
| 3,936,989 | 2/1976 | Hancock . |
| 3,953,979 | 5/1976 | Kurose . |
| 3,981,038 | 9/1976 | Vidal . |
| 3,995,434 | 12/1976 | Kato et al. . |
| 4,001,988 | 1/1977 | Riefler . |
| 4,016,693 | 4/1977 | Warren . |
| 4,023,767 | 5/1977 | Fontana . |
| 4,051,570 | 10/1977 | Hilfiker . |
| 4,067,166 | 1/1978 | Sheahan . |
| 4,098,040 | 7/1978 | Riefler . |
| 4,107,894 | 8/1978 | Mullins . |
| 4,110,949 | 9/1978 | Cambiuzzi et al. . |
| 4,124,961 | 11/1978 | Habegger . |
| 4,126,979 | 11/1978 | Hancock . |
| 4,132,492 | 1/1979 | Jenkins . |
| 4,175,888 | 11/1979 | Ijima . |
| 4,186,540 | 2/1980 | Mullins . |
| 4,187,069 | 2/1980 | Mullins . |
| 4,190,384 | 2/1980 | Neumann . |
| 4,193,718 | 3/1980 | Wahrendorf et al. . |
| 4,207,718 | 6/1980 | Schaaf et al. . |
| 4,208,850 | 6/1980 | Collier . |
| 4,214,655 | 7/1980 | Bernham et al. . |
| 4,218,206 | 8/1980 | Mullins . |
| 4,228,628 | 10/1980 | Schlomann . |
| 4,229,123 | 10/1980 | Heinzmann . |
| 4,262,463 | 4/1981 | Hapel . |
| 4,288,960 | 9/1981 | Auras . |
| 4,312,606 | 1/1982 | Sarikelle . |
| 4,314,431 | 2/1982 | Rabassa . |
| 4,324,505 | 4/1982 | Hammett . |
| 4,335,549 | 6/1982 | Dean, Jr. . |
| 4,337,605 | 7/1982 | Tudek . |
| 4,380,409 | 4/1983 | O'Neill . |
| 4,384,810 | 5/1983 | Neumann . |
| 4,426,176 | 1/1984 | Terada . |
| 4,426,815 | 1/1984 | Brown . |
| 4,449,857 | 5/1984 | Davis . |
| 4,454,699 | 6/1984 | Strobl . |
| 4,470,728 | 9/1984 | Broadbent . |
| 4,490,075 | 12/1984 | Risi et al. . |
| 4,496,266 | 1/1985 | Ruckstuhl . |
| 4,512,685 | 4/1985 | Hegle . |
| 4,524,551 | 6/1985 | Scheiwiller . |
| 4,572,699 | 2/1986 | Rinninger . |
| 4,616,959 | 10/1986 | Hilfiker . |
| 4,640,071 | 2/1987 | Haener . |
| 4,651,485 | 3/1987 | Osborne . |
| 4,658,541 | 4/1987 | Haile . |
| 4,660,342 | 4/1987 | Salisbury . |
| 4,661,023 | 4/1987 | Hilfiker . |
| 4,671,706 | 6/1987 | Giardini . |
| 4,684,294 | 8/1987 | O'Neill . |
| 4,711,606 | 12/1987 | Leling et al. . |
| 4,726,567 | 2/1988 | Greenberg . |
| 4,728,227 | 3/1988 | Wilson et al. . |
| 4,784,821 | 11/1988 | Leopold . |
| 4,802,320 | 2/1989 | Forsberg . |
| 4,802,836 | 2/1989 | Whissell . |
| 4,815,897 | 3/1989 | Risi et al. ..... 52/592.6 X |
| 4,824,293 | 4/1989 | Brown et al. . |
| 4,825,619 | 5/1989 | Forsberg . |
| 4,860,505 | 8/1989 | Bender . |
| 4,884,921 | 12/1989 | Smith . |
| 4,896,999 | 1/1990 | Ruckstuhl . |
| 4,909,010 | 3/1990 | Gravier . |
| 4,909,717 | 3/1990 | Pardo . |
| 4,914,876 | 4/1990 | Forsberg . |
| 4,936,712 | 6/1990 | Glickman . |
| 4,990,032 | 2/1991 | Smith . |
| 5,017,049 | 5/1991 | Sievert . |
| 5,031,376 | 7/1991 | Bender et al. . |
| 5,044,834 | 9/1991 | Janopaul, Jr. . |
| 5,062,610 | 11/1991 | Woolford et al. . |
| 5,158,132 | 10/1992 | Guillemot . |
| 5,163,261 | 11/1992 | O'Neill ..... 52/592.6 X |
| 5,294,216 | 3/1994 | Sievert ..... 52/604 X |
| 5,337,527 | 8/1994 | Wagenaar ..... 405/284 X |
| 5,350,256 | 9/1994 | Hammer ..... 52/604 X |

| | | | |
|---|---|---|---|
| 5,353,569 | 10/1994 | Rodrique | 52/608 X |
| 5,425,600 | 6/1995 | Gordon | 405/284 |
| 5,490,363 | 2/1996 | Woolford . | |
| 5,505,034 | 4/1996 | Dueck | 52/592.6 X |
| 5,537,796 | 7/1996 | Kliethermes, Jr. | 52/592.6 |

FOREIGN PATENT DOCUMENTS

| | | |
|---|---|---|
| 1040452 | 10/1978 | Canada . |
| 1065154 | 10/1979 | Canada . |
| Des. 47747 | 1/1981 | Canada . |
| 50020 | 7/1982 | Canada . |
| 51160 | 4/1983 | Canada . |
| Des. 51160 | 4/1983 | Canada . |
| Des. 51313 | 5/1983 | Canada . |
| Des. 51794 | 9/1983 | Canada . |
| 1182295 | 2/1985 | Canada . |
| 1188116 | 6/1985 | Canada . |
| 1194703 | 10/1985 | Canada . |
| 1197391 | 12/1985 | Canada . |
| 1204296 | 5/1986 | Canada . |
| Des. 62875 | 4/1989 | Canada . |
| Des. 63365 | 5/1989 | Canada . |
| Des. 63366 | 5/1989 | Canada . |
| Des. 65896 | 4/1990 | Canada . |
| Des. 66760 | 8/1990 | Canada . |
| Des. 67904 | 1/1991 | Canada . |
| 2012286 | 9/1991 | Canada . |
| 0 039 372 | 11/1981 | European Pat. Off. . |
| 0 130 921 | 1/1985 | European Pat. Off. . |
| 0 170 113 | 7/1985 | European Pat. Off. . |
| 0 215 991 | 9/1985 | European Pat. Off. . |
| 0 215 991 | 4/1987 | European Pat. Off. . |
| 0 322 668 | 12/1988 | European Pat. Off. . |
| 0 362 110 | 4/1990 | European Pat. Off. . |
| 0 490 534 | 6/1992 | European Pat. Off. . |
| 392.474 | 11/1908 | France . |
| 1.360.872 | 4/1963 | France . |
| 2.28.900 | 5/1974 | France . |
| 2 243 304 | 9/1974 | France . |
| 2343 871 | 5/1976 | France . |
| 2 422 780 | 12/1978 | France . |
| 2409351 | 6/1979 | France . |
| 2 463 237 | 8/1979 | France . |
| 2465 035 | 9/1979 | France . |
| 2 622 227 | 12/1989 | France . |
| 2 476 179 | 8/1991 | France . |
| 22 59 654 | 6/1974 | Germany . |
| 18 11 932 | 6/1978 | Germany . |
| 27 55 833 | 7/1978 | Germany . |
| 27 19 107 | 11/1978 | Germany . |
| 28 41 001 | 9/1980 | Germany . |
| 34 01 629 | 7/1984 | Germany . |
| 90 15 196 | 2/1991 | Germany . |
| 341611 | 7/1936 | Italy . |
| 456776 | 4/1950 | Italy . |
| 459942 | 10/1950 | Italy . |
| 709599 | 6/1966 | Italy . |
| 92167 | 7/1948 | New Zealand . |
| 151299 | 4/1969 | New Zealand . |
| 151299 | 9/1969 | New Zealand . |
| 218830 | 9/1989 | New Zealand . |
| 215196 | 12/1989 | New Zealand . |
| 24781 | 5/1993 | New Zealand . |
| 25131 | 6/1994 | New Zealand . |
| 25132 | 6/1994 | New Zealand . |
| 25133 | 6/1994 | New Zealand . |
| 27313 | 6/1996 | New Zealand . |
| 27314 | 6/1996 | New Zealand . |
| 27315 | 6/1996 | New Zealand . |
| 27316 | 6/1996 | New Zealand . |
| 27317 | 6/1996 | New Zealand . |
| 27318 | 6/1996 | New Zealand . |
| 27346 | 9/1996 | New Zealand . |
| 27675 | 9/1996 | New Zealand . |
| 27676 | 9/1996 | New Zealand . |
| 27677 | 9/1996 | New Zealand . |
| 205452 | 9/1939 | Switzerland . |
| 657 172 | 8/1986 | Switzerland . |
| 669 001 | 2/1989 | Switzerland . |
| 678160 | 8/1979 | U.S.S.R. . |
| 1145106 A | 3/1985 | U.S.S.R. . |
| 336 | of 1871 | United Kingdom . |
| 107 338 | 7/1917 | United Kingdom . |
| 154397 | 11/1920 | United Kingdom . |
| 536434 | 12/1940 | United Kingdom . |
| 537153 | 6/1941 | United Kingdom . |
| 970 595 | 9/1964 | United Kingdom . |
| 1 385 207 | 1/1975 | United Kingdom . |
| 1 386 088 | 3/1975 | United Kingdom . |
| 1 477 139 | 6/1977 | United Kingdom . |
| 2 091 775 | 8/1982 | United Kingdom . |
| 2 127 872 | 4/1984 | United Kingdom . |
| 2 213 095 | 8/1989 | United Kingdom . |

OTHER PUBLICATIONS

*Versa Lock* Product Literature (date unknown).
*Johnson Block* Product Literature (date unknown).
Orco Block Co. *Split Face Block* Product Literature (date unknown).
*Handy–Stone Retaining Wall System* Product Literature (date unknown).
*Aztech Wall System* Installation Guide, Block Systems, Inc. (1989).
*EZ Wall Systems* Product Literature, Rockwood Retaining Wall Systems, Inc. (date unknown).
*Windsor Stone* Product Literature, Block Systems, Inc. (1991).
*Diamond Wall Systems: The Cutting Edge,* Anchor Block Co. (date unknown).
Various Diamond Wall System 4 and 4.4 Concrete Masonry Units Tech Spec's, Anchor Block (1988, 1989).
*Modular Concrete Block,* the Besser Co. (date unknown).
*Paving Stone: New Lock With Old World Charm,* the Besser Co. (date unknown).
*Keystone International Compac Unit* Product Literature (1992).
*Keystone Retaining Wall Systems* Product Literature (1992).
*Garden Wall* Product Literature (1991).
Standard Load–Bearing Wall Tile Literature (1924).
Anchor Autoclave Product Literature (1990).
PISA II, Interlocking Retaining Wall System, Interlock Paving Company, (1988).
Besser, Technical Data for the Blockmaker, Besser Research and Training Center, pp. 33 and 34 (1962).
Besser, Concrete Paving Stones, Manual No. 8601—Section 5, Besser Company, pp. 1–24.
Besser, Parts and Equipment, Besser Company, pp. 1–80 (before 1990).
Installation & Design Manual, Rockwood Classic, The one–piece easy to use system, Rockwood Retaining Walls, Inc.
Creative Alternatives, Block Systems Incorporated, Concrete Ideas, (1989).
Diamond Wall System Installation Guide, Diamond Wall System, Block Systems, Inc. (1989).
Bulletin 7062, Jul. 1, 1994.
Single–element retaining wall system is ideal for block producers, Robert L. Hubler, Jr., Sep., 1983.
A Review of Paver Production On Besser Block Machines, Lucas E. Pfeiffenberger, pp. 35–37, (1984).

FIG. 7
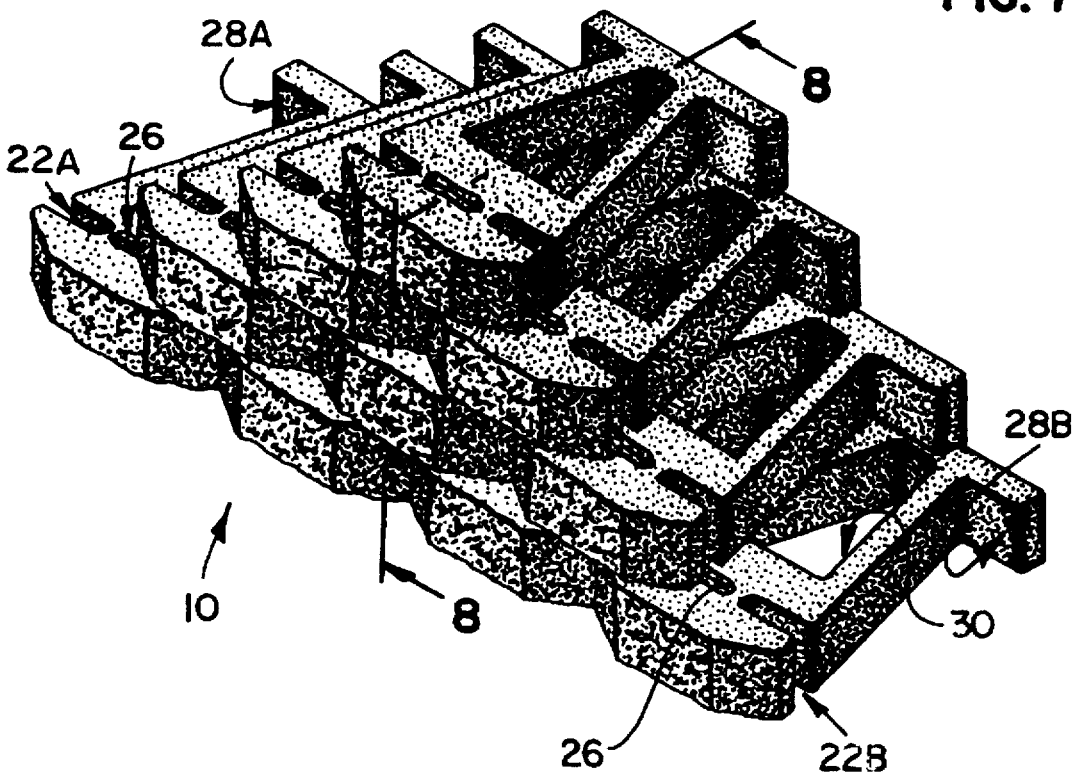
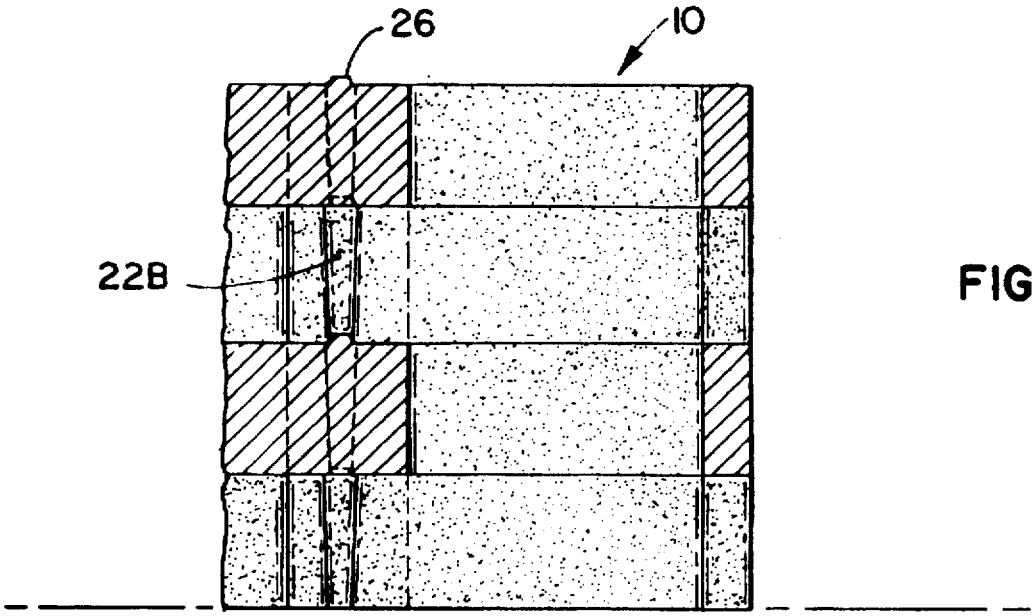
FIG. 8

COMPOSITE MASONRY BLOCK

This application is a continuation patent application of U.S. patent application Ser. No. 08/434,779, filed on May 4, 1995 which was a division of U.S. patent application Ser. No. 08/130,298, filed Oct. 1, 1993, now abandoned; which is a continuation-in-part of U.S. patent application Ser. No. 08/056,986, filed May 4, 1993; now abandoned which was a continuation of U.S. patent application Ser. No. 07/957,598, filed Oct. 6, 1992, now abandoned, which applications are incorporated herein by reference.

FIELD OF THE INVENTION

The invention generally relates to concrete masonry blocks. More specifically, the invention relates to concrete masonry blocks which are useful in forming various retaining structures.

BACKGROUND OF THE INVENTION

Soil retention, protection of natural and artificial structures, and increased land use are only a few reasons which motivate the use of landscape structures. For example, soil is often preserved on a hillside by maintaining the foliage across that plain. Root systems from the trees, shrubs, grass, and other naturally occurring plant life, work to hold the soil in place against the forces of wind and water. However, when reliance on natural mechanisms is not possible or practical, man often resorts to the use of artificial mechanisms such as retaining walls.

In constructing retaining walls, many different materials may be used depending on the given application. If a retaining wall is intended to be used to support the construction of a roadway, a steel wall or a concrete and steel wall may be appropriate. However, if the retaining wall is intended to landscape and conserve soil around a residential or commercial structure, a material may be used which compliments the architectural style of the structure such as wood timbers or concrete block.

Of all these materials, concrete block has received wide and popular acceptance for use in the construction of retaining walls and the like. Blocks used for these purposes include those disclosed by Forsberg, U.S. Pat. Nos. 4,802,320 and Design 296,007, among others.

Previously, blocks have been designed to "setback" at an angle to counter the pressure of the soil behind the wall. Setback is generally considered the distance in which one course of a wall extends beyond the front surface of the next highest course of the same wall. Given blocks of the same proportion, setback may also be regarded as the distance which the back surface of a higher course of blocks extends backwards in relation to the back surface of a lower course of the wall.

There is often a need in the development of structures such as roadways, abutments and bridges to provide maximum usable land and a clear definition of property lines. Such definition is often not possible through use of a composite masonry block which results in a setback wall. For example, a wall which sets back by its very nature will cross a property line and may also preclude maximization of usable land in the upper or subjacent property. As a result, a substantially vertical wall is more appropriate and desirable.

However, in such instances, vertical walls may be generally held in place through the use of well known mechanisms such as pins, deadheads, tie backs or other anchoring mechanisms to maintain the vertical profile of the wall. Besides being complex, anchoring mechanisms such as pin systems often rely on only one strand or section of support tether which, if broken, may completely compromise the structural integrity of the wall. Reliance on such complex fixtures often discourages the use of retaining wall systems by the everyday homeowner. Commercial landscapers may also avoid complex retaining wall systems as the time and expense involved in constructing these systems is not supportable given the price at which landscaping services are sold.

Further, retaining structures are often considered desirable in areas which require vertical wall but are not susceptible to any number of anchoring matrices or mechanisms. For example, in the construction of a retaining wall adjacent a building or other structure, it may not be possible to provide anchoring mechanisms such as a matrix web, deadheads or tie backs far enough into the retained earth to actually support the wall. Without a retaining mechanism such as a matrix web, tie-back, or dead head, many blocks may not offer the high mass per face square foot necessary for use in retaining structures which have a substantially vertical profile.

Manufacturing processes may also present impediments to structures of adequate integrity and strength. Providing blocks which do not require elaborate pin systems or other secondary retaining and aligning means and are still suitable for constructing structures of optimal strength is often difficult. Two examples of block molding systems are disclosed in commonly assigned Woolford et al, U.S. Pat. No. 5,062,610 and Woolford, U.S. patent application Ser. No. 07/828,031 filed Jan. 30, 1992 which are incorporated herein by reference. In both systems, advanced design and engineering is used to provide blocks of optimal strength and, in turn, structures of optimal strength, without the requirement of other secondary systems such as pins and the like. The Woolford et al patent discloses a mold which, through varying fill capacities provides for the uniform application of pressure across the fill. The Woolford application discloses a means of forming block features through the application of heat to various portions of the fill.

As can be seen there is a need for a composite masonry block which is stackable to form walls of high structural integrity without the use of complex pin and connection systems and without the need for securing mechanisms such as pins, or tie backs.

SUMMARY OF THE INVENTION

In accordance with a first aspect of the invention, there is provided a pinless composite masonry block having a high unit mass per front surface square foot. The block comprises a front surface and a back surface adjoined by first and second side surfaces, a top surface and a bottom surface each lying adjacent the front, back, and first and second side surfaces. In use, the block may be made to form vertical or set back walls without pins or other securing mechanisms as a result of the high mass per front surface square foot.

In accordance with an additional aspect of the invention there is provided structures resulting from the blocks of the invention. In accordance with a further aspect of the invention there is provided a mold and method of use resulting in the block of the invention.

BRIEF DESCRIPTION OF THE DRAWINGS

FIG. 7 is a perspective view of a retaining structure constructed with one embodiment of the composite masonry block of the invention.

FIG. 8 is a cut away view of the wall shown in FIG. 7 showing a vertical wall taken along lines 8—8.

DETAILED DESCRIPTION OF THE PREFERRED EMBODIMENTS

Figure 1:
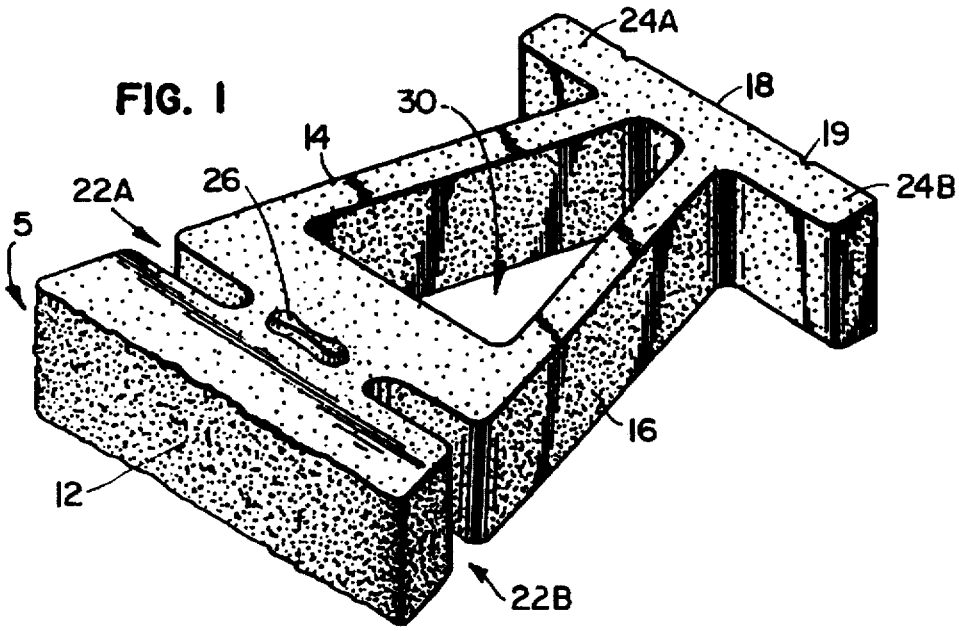
FIG. 1 is a perspective view of one preferred embodiment of the block in accordance with the invention.

Turning to the figures wherein like parts are designated with like numerals throughout several views, there is shown a composite masonry block in FIG. 1. The block generally comprises a front surface 12 and a back surface 18 adjoined by first and second side surfaces 14 and 16, respectively, as well as a top surface 10 and a bottom surface 8 each lying adjacent said front 12, back 18, and first 14 and second 16 side surfaces. Each of said side surfaces has an inset, 22A and 22B, spanning from the block top surface 10 to the block bottom surface 8. The block top surface 10 may also comprise one or more protrusions 26. Each protrusion is preferably positioned adjacent an inset 22A or 22B, on the block top surface 10. The block back surface 18 generally comprises first and second legs 24A and 24B, respectively. The first leg 24A extends from the back surface 18 beyond the plane of the block first side 14. The second leg 24B extends from the back surface 18 beyond the plane of the block second side 16.

Composite Masonry Block

The composite masonry block of the invention generally comprises a block body. The block body 5 functions to retain earth without the use of secondary mechanisms such as pins, dead heads, webs and the like. Preferably, the block body provides a retaining structure which may be manually positioned by laborers while also providing a high relative mass per square foot of face or front surface presented in the wall. To this end, the block may generally comprise a six-surface article.

Figure 2:
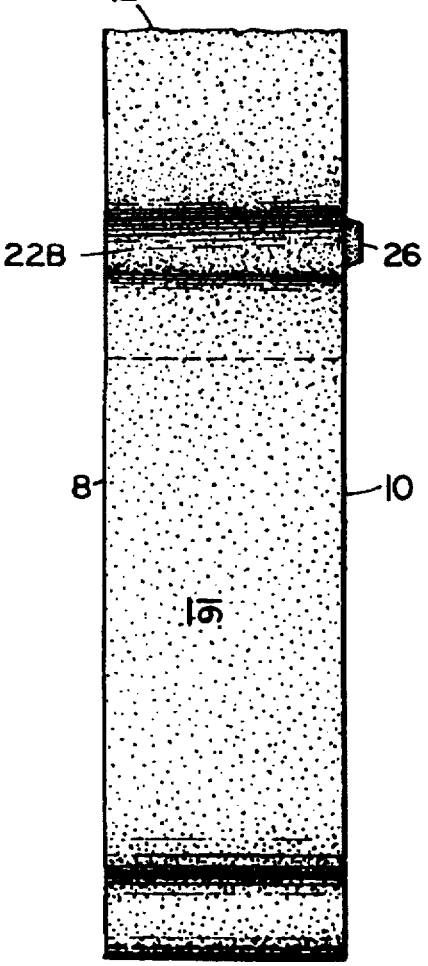
FIG. 2 is a side plan view of the block of FIG. 1.
Figure 3:
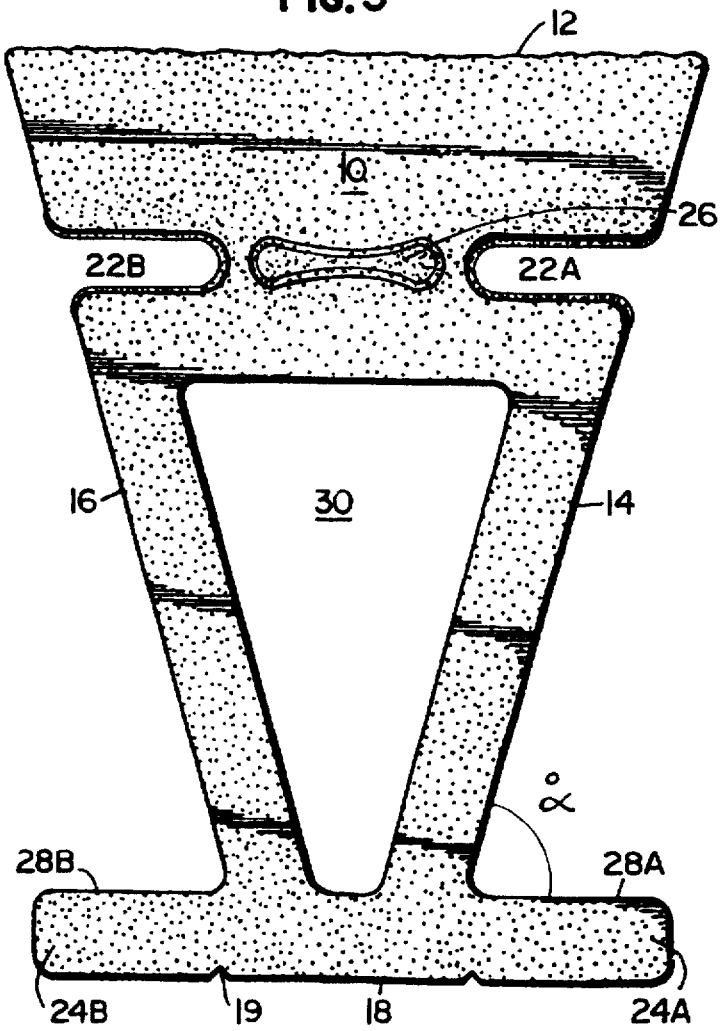
FIG. 3 is a top plan view of the block of FIG. 1.
Figure 6A:
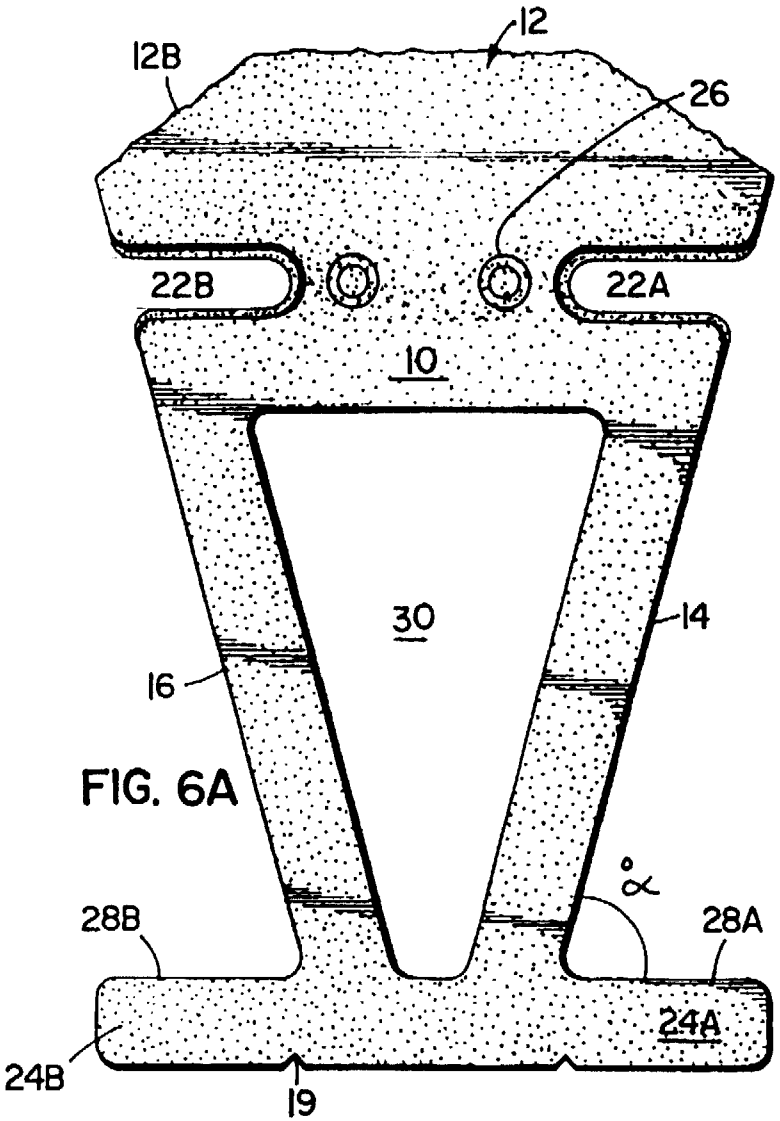
FIG. 6A is a top plane view of an alternative embodiment of the block of FIG. 4.
Figure 3A:
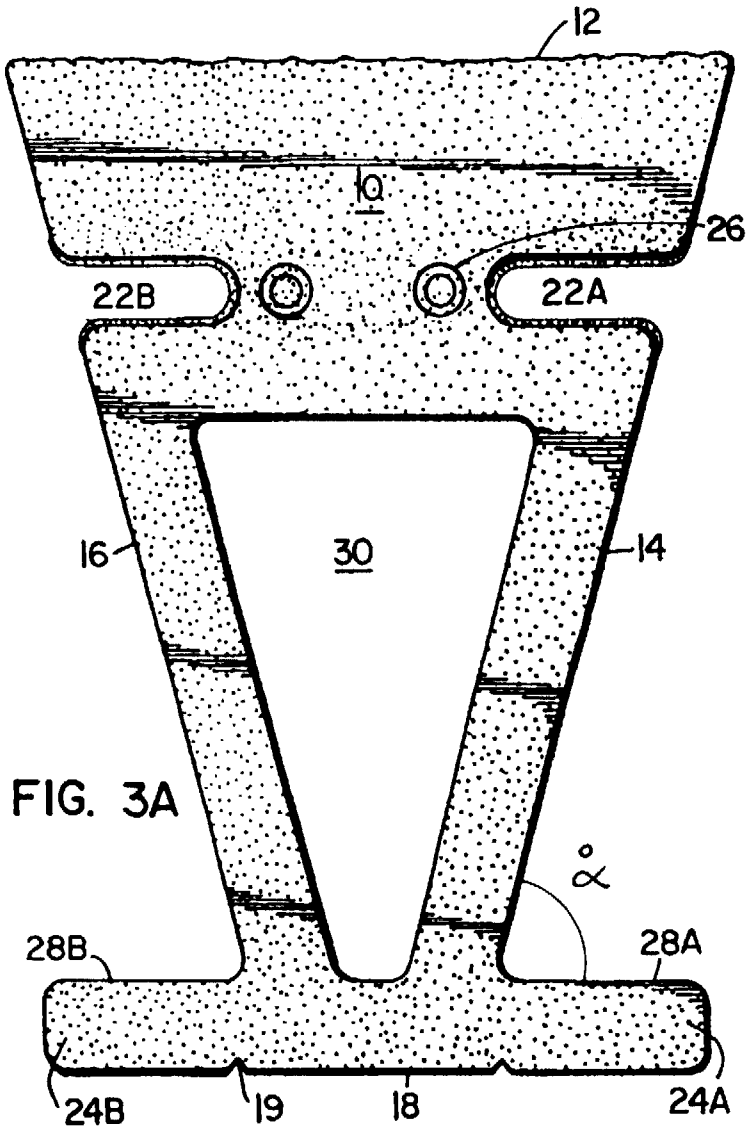
FIG. 3A is a top plane view of an alternative embodiment of the block of FIG. 1.

The most apparent surface of the block is generally the front surface 12 which functions to provide an ornamental or decorative look to the retaining structure, FIGS. 1–3. The front surface of the block may be flat, rough, split, convex, concave, or radial. Any number of designs may be introduced into the front surface. Two preferred front surfaces may be seen in FIGS. 1–3 and 4–6. Additionally, two alternative embodiments of the block of the invention may be seen in FIGS. 9–11. The block of the invention may comprise a flat or planar front surface or a roughened front surface 12 created by splitting a portion of material from the front of the block, FIG. 1–3. In accordance with one other embodiment of the invention, the block may comprise a split or faceted front surface having three sides, FIGS. 4–6.

The block of the invention generally also comprises two side surfaces 14 and 16, FIGS. 1–6. These side surfaces assist in definition of the block shape as well as in the stacked alignment of the block. Generally, the block of the invention may comprise side surfaces which take any number of forms including flat or planar side surfaces, angled side surfaces, or curved side surfaces. The side surfaces may also be notched, grooved, or otherwise patterned to accept any desired means for further aligning or securing the block during placement.

One preferred design for the side surfaces may be seen in FIGS. 1–6. As can be seen, the side surfaces 14 and 16 are angled so as to define a block which has a greater width at the front surface 12 than at the back surface 18. Generally, the angle of the side surfaces (See FIGS. 3 and 6) in relationship to the back surface as represented by alpha degrees, may range from about 70° to 90°, with an angle of about 75° to 85°, being preferred.

The side surfaces may also comprise insets 22A and 22B for use in receiving other means which secure and align the blocks during placement. In accordance with one embodiment of the invention, the insets may span from the block top surface 10 to the block bottom surface 8. Further, these insets may be angled across the height of the block to provide a structure which gradually sets back over the height of the wall. When mated with protrusions 26, the insets may also be angled to provide a retaining wall which is substantially vertical.

The angle and size of the insets may be varied in accordance with the invention. However, the area of the inset adjacent the block bottom surface 8 should be approximately the same area as, or only slightly larger than, protrusion 26 with which it will mate. The area of the insets adjacent the block top surface 10 is preferably larger than the protrusion 26 by a factor of 5% or more and preferably about 1% to 2% or more. This will allow for adequate movement in the interfitting of blocks in any structure as well as allowing blocks of higher subsequent courses to setback slightly in the retaining structure. Further, by varying the size and position of the inset relative to protrusion 26, the set back of the wall may be varied. Further, by varying the position of the protrusion within an inset of greater relative size the set back of a retaining structure may be varied in the structure. For example, by pulling the blocks forward as far as possible a setback of about ⅛" may be attained in the wall. By pushing the blocks backward as far as possible, a set back of up to ¾" may be attained. Hereagain, movement forward and backward is the movement of protrusion 26 within the confines of insets 22A and 22B.

Generally, the top 10 and bottom 8 surfaces of the block function similarly to the side surfaces of the block. The top 10 and bottom 8 surfaces of the block serve to define the structure of the block as well as assisting in the aligned positioning of the block in any given retaining structure. To this end, the top and bottom surfaces of the block are generally flat or planar surfaces.

Preferably, as can be seen in FIGS. 1–6, either the top or bottom surface comprises a protrusion 26. The protrusion functions in concert with the side wall insets 22A and 22B to secure the blocks in place when positioned in series or together on a retaining structure by aligning the protrusions 26 within the given insets. While the protrusions may take any number of shapes, they preferably have a kidney or dogbone shape. As can be seen in FIGS. 1–6 as well as FIGS. 9–11, the protrusion may comprise two circular or oblong sections which are joined across their middle by a narrower section of the same height. The central narrow portion in the protrusion 26 (FIGS. 1–6) allows for orientation of the blocks to provide inner curving and outer curving walls by the aligned seating and the relative rotation of the protrusion 26 within, and in relationship to, any block inset 22A or 22B. In turn, the larger surface area of the dogbone naturally gives this protrusion greater strength against forces which otherwise could create movement among individual wall blocks or fracture of this element of the block.

Generally, the protrusions may comprise formed nodules or bars having a height ranging from about ⅜ inch to ¾ inch, and preferably about ½ inch to ⅝ inch. The width or diameter of the protrusions may range from about 1 inch to 3 inches, and preferably about 1½ inches to 2½ inches. In shipping, the protrusions may be protected by stacking the blocks in inverted fashion, thereby nesting the protrusions within opening 30.

Generally, the protrusions 26 and insets 22A and 22B may be used with any number of other means which function to assist in securing the retaining wall against fill. Such devices include tie backs, deadheads, as well as web matrices such as GEOGRID® available from Mirafi Corp. or GEOMET® available from Amoco.

The back surface 18 of the block generally functions in defining the shape of the block, aligning the block as an element of any retaining structure, as well as retaining earth or fill. To this end, the back surface of the block may take any shape consistent with these functions.

One preferred embodiment of the block back surface can be seen in FIGS. 1–6. In accordance with the invention, the back surface may preferably be planar and have surfaces 28A and 28B which extend beyond the side surfaces of the block. In order to make the block more portable and easily handled, the block may be molded with any number of openings including central opening 30. This central opening 30 in the block allows for a reduction of weight during molding. Further, these openings allow for the block to be filled with earth or other product such as stone, gravel, rock, and the like which allows for an increase in the effective mass of the block per square foot of front surface. Openings may also be formed in the front portion of the blocks as can be seen by openings 34 and 36. Additional fill may be introduced into openings 30, 34, and 36 as well as the openings formed between surfaces 28A and 28B and adjacent side walls 14 and 16, respectively.

In use, a series of blocks are preferably placed adjacent each other, forming a series of fillable cavities. Each block preferably will have a central cavity 30 for filling as well as a second cavity formed between any two adjacently positioned blocks. This second cavity is formed by opposing side walls 14 and 16, and adjacently positioned back surfaces 28A and 28B. This second cavity, formed in the retaining structure by the two adjacent blocks, holds fill and further increases the mass or actual density of any given block structure per square foot of front surface area.

Generally, an unfilled block may weigh from about 115 to 155 pounds, preferably from about 115 to 125 pounds per square foot of front surface. Once filled, the block mass will vary depending upon the fill used but preferably the block may retain a mass of about 160 to 180 pounds, and preferably about 165 to 175 pounds per square foot of front surface when using rock fill such as gravel or class 5 road base.

Figure 9:
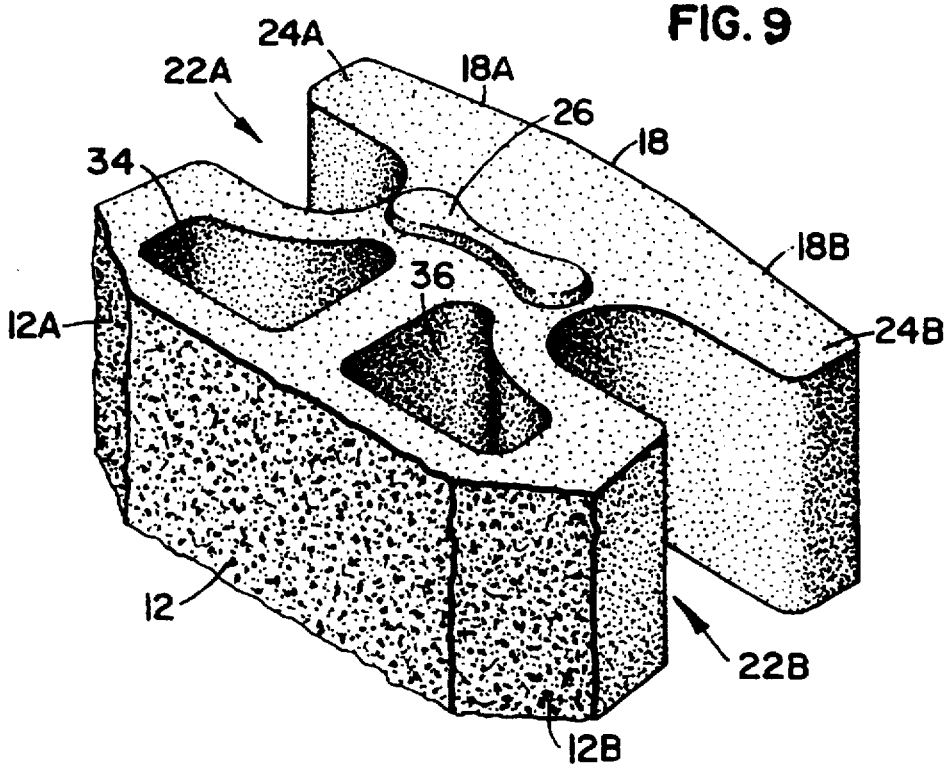
FIG. 9 is a perspective view of a further alternative embodiment of the block in accordance with the invention.
Figure 10:
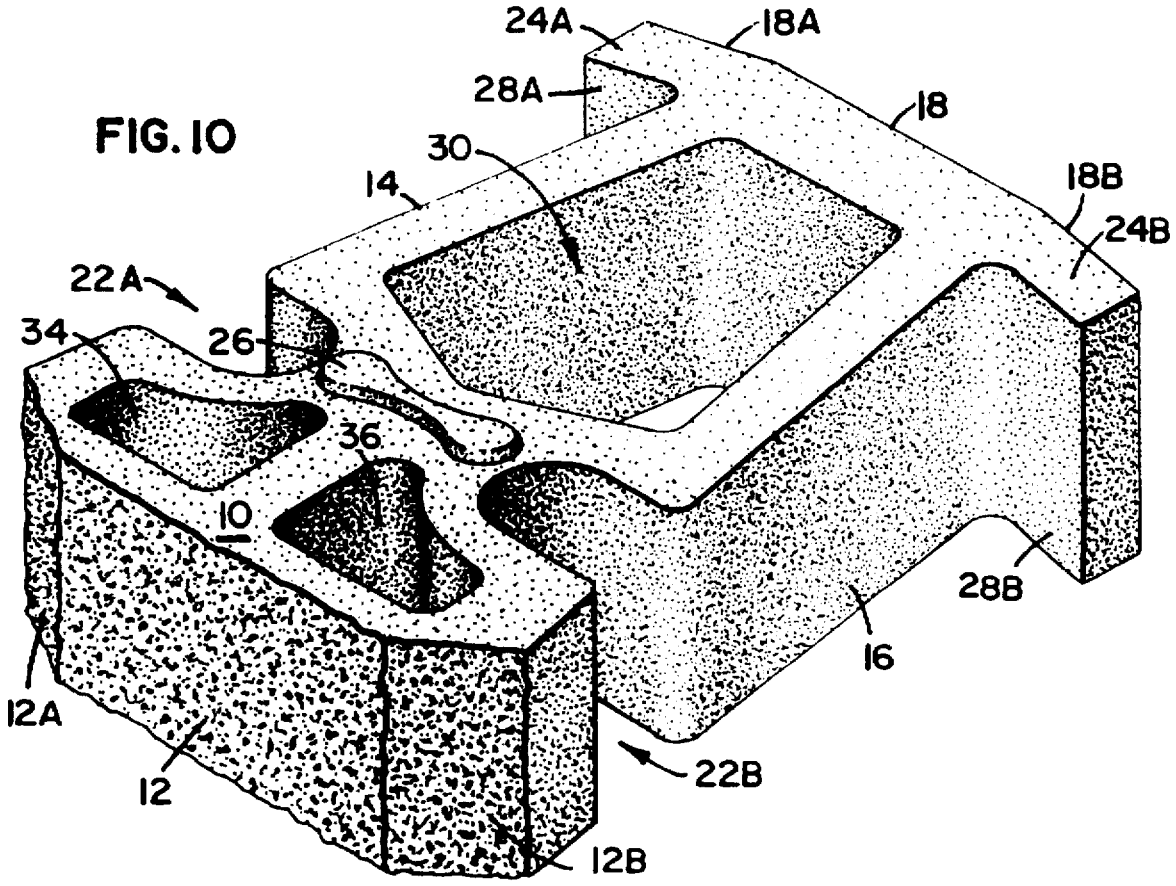
FIG. 10 is a perspective view of another further alternative embodiment of the block in accordance with the invention.
Figure 11:
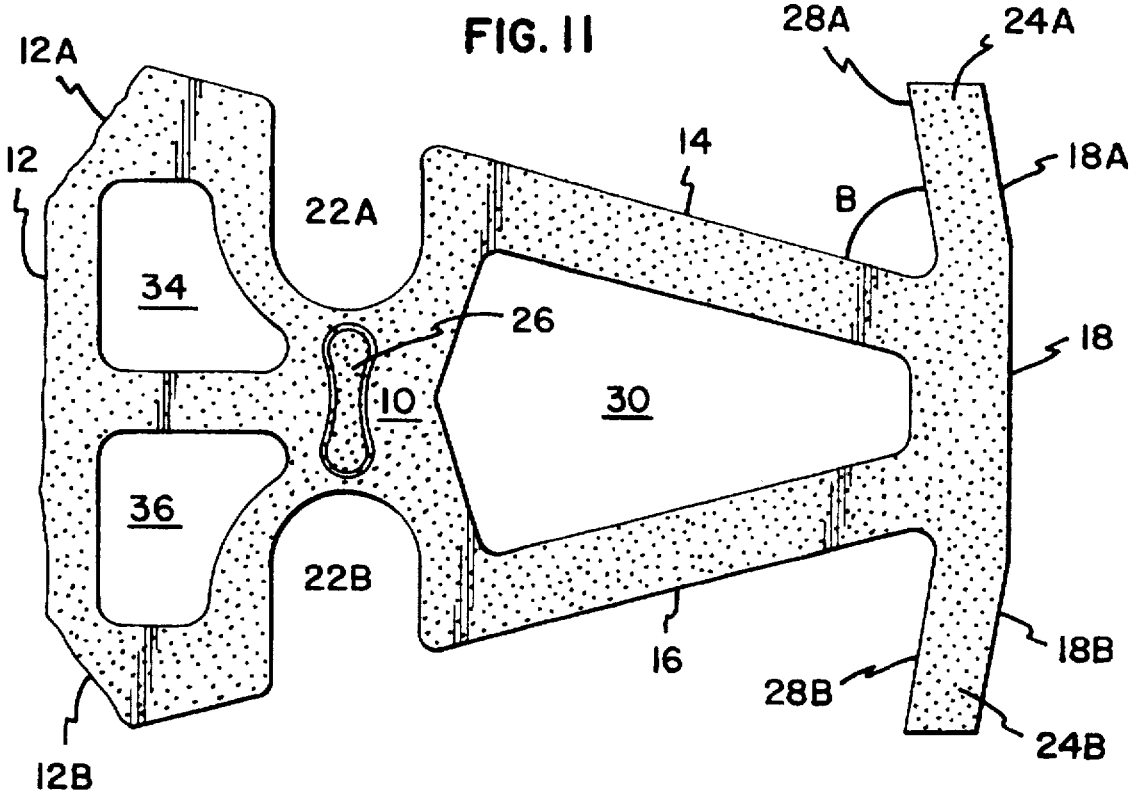
FIG. 11 is a top plan view of the block depicted in FIG. 10.

Two alternative preferred embodiments of the invention can be seen in FIGS. 9–11. First, as can be seen in FIG. 9, there is depicted a block having cavities 34 and 36 for accepting fill. Further, this block also has sidewall insets 22A and 22B and a protrusion for complimentary stacking with the blocks shown in FIGS. 1–6 or FIGS. 10–11. Consistent with the other embodiments of the block disclosed herein, this block allows for finishing walls having base courses of larger heavier blocks with blocks which are smaller, lighter and easier to stack on the higher or highest courses. While not required, the block depicted in FIGS. 1–6 and 10–11 may be larger in dimension than the block of FIG. 9 from the front surface to back surface allowing for the construction of a structure such as that shown in FIG. 12. Further, the use of the dogbone shaped protrusion 26 allows for retention of these blocks in an interlocking fashion with the blocks of lower courses to form a wall of high structural integrity, (see FIG. 12).

The blocks depicted in FIG. 9 may weigh from about 60 to 100 pounds, preferably from about 75 to 95 pounds, and most preferably from about 80 to 90 pounds, with the filled block mass varying from about 90 to 130 pounds, preferably from about 95 to 125 pounds, and most preferably from about 105 to 115 pounds per square foot of front surface using rock fill such as gravel or class 5 road base.

Another alternative embodiment of the block of the invention can be seen in FIGS. 10 and 11. As can be seen, the block depicted in FIGS. 10 and 11 has angled first and second legs 24A and 24B, respectively, as well as an angled back wall sections, 18, 18A, and 18B.

The resulting back surfaces 28A and 28B, (FIG. 11), have a reduced angle alpha which increases the structural integrity of the wall by increasing the walls resistance to blow out. The angled back surfaces 28A and 28B provide a natural static force which resist the pressure exerted by the angle of repose of fill on any given retaining structure. The angled back surfaces 28A and 28B may be anchored in fill placed between adjacent blocks. Any force attempting to move this block forward, will have to also confront the resistance created by the forward angled back legs moving into adjacently positioned fill or, if the base course, the ground beneath the wall.

The use of angled back walls also facilitates manufacture of the blocks of the invention. Specifically, the angled back sides 28A and 28B assist in allowing the conveying of blocks once they have been compressed and formed, and they are being transported to the curing facility. Generally, the proximity of the blocks on the conveyer may lead to physical contact. If this contact occurs at a high speed, the blocks may be physically damaged. Also, the use of a conveyer which turns on curves in the course of transporting may naturally lead to contact between blocks and damage. Angling the back side legs 24A and 24B allows easier and more versatile conveyer transport and strengthens the back side legs.

Angling the back sides of the block also assists in the formation of a cell when two blocks are placed adjacent to each other in the same plane. This cell may be used to contain any assortment of fill including gravel, sand, or even concrete. The design of the block of the invention allows the staggered or offset positioning of blocks when building a retaining wall structure. The internal opening 30 of the blocks depicted in FIGS. 1–6 and 10–11 may be used in conjunction with the cells created by the adjacent blocks to create a network of channels for the deposition of fill. Specifically, with the offset placement blocks from one course to the next, the opening 30 of a second course block may be placed over a cell created by two blocks positioned adjacent each other in the first course. Thus, opening 30 in second course block is aligned with a cell in the next lower course and this cell may be filled by introducing gravel, sand, etc. into the opening in the second course block. The addition of further courses allows the formation of a series of vertical channels across the retaining structure, (see FIG. 7).

From the axis created by back wall 18 the back legs 24A and 24B may angle towards the front surface of the block ranging from about 5 degrees to 20 degrees, preferably about 7 degrees to 15 degrees, and most preferably about 10 degrees to twelve degrees. The angle beta may generally range from about 60 to 80 degrees, preferably about 60 to 75 degrees, and most preferably about 65 to 70 degrees. Further, this block (FIGS. 10 and 11) may vary in weight from about 100 to 150 pounds, preferably about 110 to 140 pounds, and most preferably from about 115 to 125 pounds, with the filled block mass varying from about 210 to 265 pounds, preferably from about 220 to 255 pounds, and most preferably from about 225 to 240 pounds per square foot of front surface using rock fill such as gravel or class 5 road base.

A further preferred embodiment of the invention may be seen in FIGS. 13–16. We have discovered that when constructing structures such as those seen in FIGS. 7 and 8, as well as FIG. 12, (for example a retaining wall), several concerns may arise depending upon the dimensions of the block, length and height of the structure, environmental conditions including the nature of the fill used behind the wall as well as the environment in which the wall is placed including landscape geography, weather, etc. Additionally, depending upon the block manufacturing process used, certain concerns with the dimensions of the block as well as the various protrusions, openings, and associated block features, may also be raised. Specifically, when constructing the landscape structure such as that shown in FIG. 8, the structure is generally assembled one course at a time while the appropriate fill is placed behind the wall. Once complete, the pressure on the wall will tend to force blocks of each subsequently higher course outward towards the front of the wall. The interlocking nature of the protrusion 26 and insets, 22A and 22B, will generally resist the movement between the blocks of any two given courses.

We have found that the structural integrity of a composite masonry block structure generally comes from the coefficient of friction between the blocks of adjacent courses, the footprint of the blocks used in the structure, as well as the nature of the protrusion 26. Generally, the protrusion functions to secure the block on which it is placed or the blocks of the next adjacent course by interfitting with insets 22A and 22B. By using a protrusion having sidewalls of varying angles, the tendency for blocks to push forward out from the wall due to physical stresses is substantially reduced. Further, we have also found that by using a protrusion having sidewalls of varying angles, manufacturing may be streamlined and efficiency increased.

Figure 13:
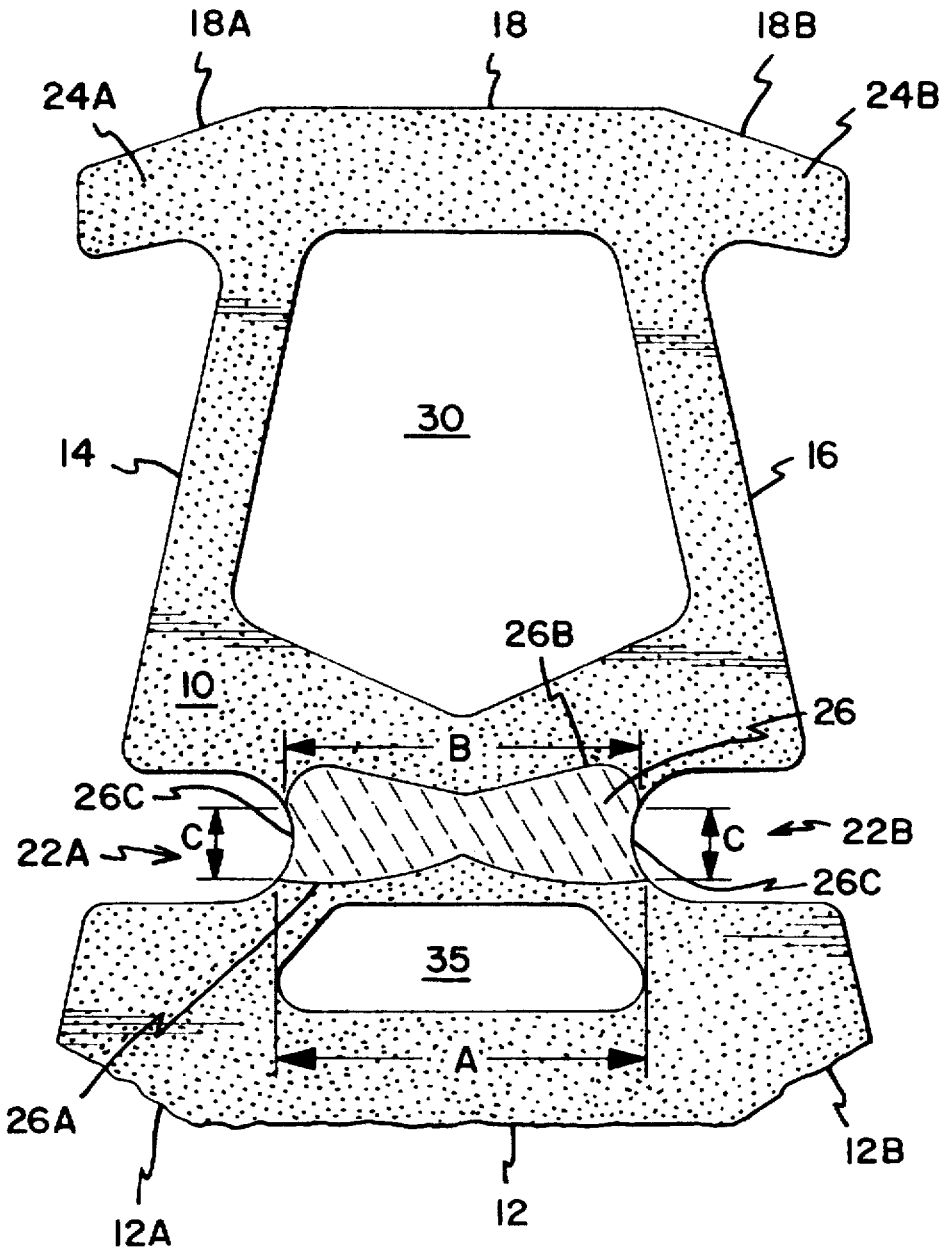
FIG. 13 is a top plan view of a block in accordance with a preferred alternative aspect of the invention.
Figure 14:
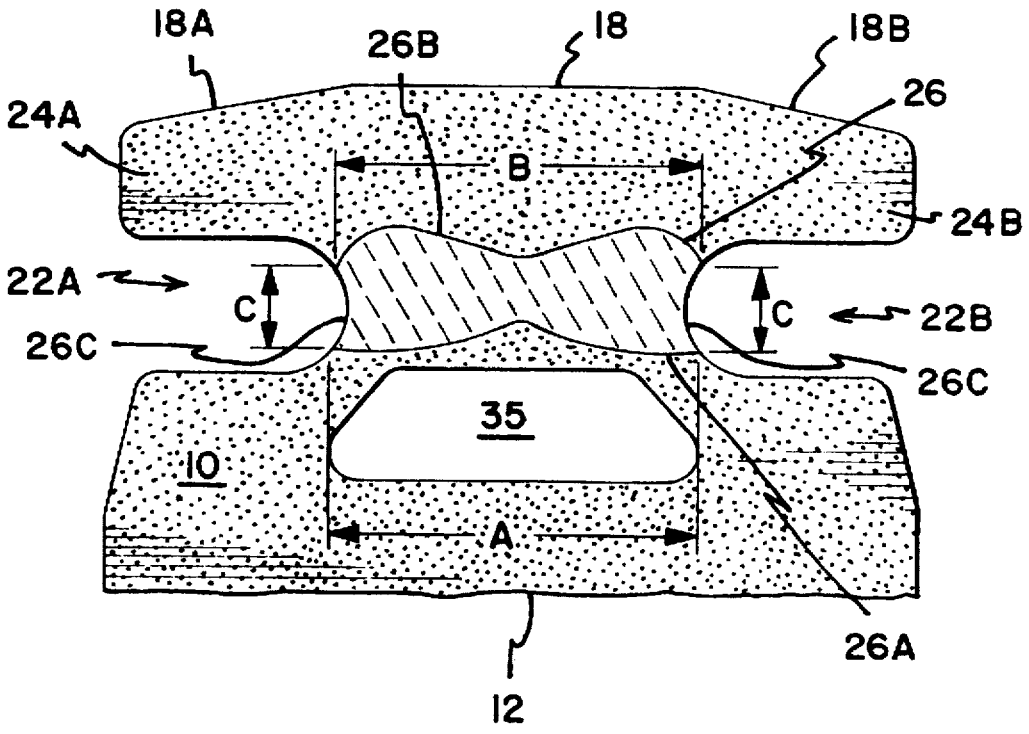
FIG. 14 is a top plan view of a block in accordance with a further preferred alternative aspect of the invention.

As can be seen in FIGS. 13 and 14, the composite masonry blocks in accordance with this aspect of the invention are generally similar to those shown in FIGS. 9–11. These blocks comprise openings 30 and 35 as well as a front face 12 which may be faceted (see FIG. 13 at 12A and 12B), or unfaceted (see FIG. 14). These blocks provide insets, 22A and 22B, as well as, a protrusion 26 which may span a portion of the upper surface 10 of the block and may boarder the insets 22A and 22B.

Generally, as can be seen in FIGS. 13 and 14, the protrusion can have four sides. The angle on each of these four sides may vary in accordance with the invention to provide for a more secure placement of blocks as well as ease in processing. Side 26A represented by length A may generally be found adjacent opening 35. Protrusion side 26B spanning length B may generally be found adjacent opening 30. In turn, sides 26C generally span length C may be found adjacent insets 22A and 22B.

Figure 15:
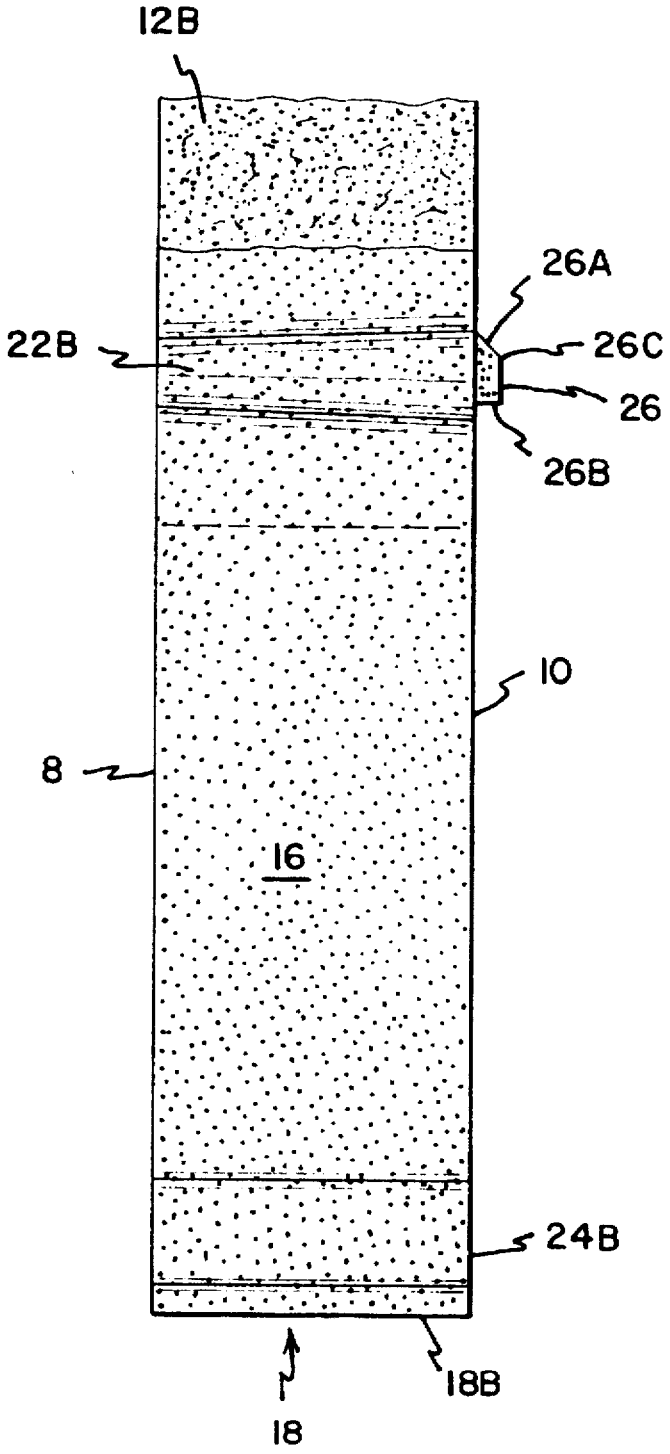
FIG. 15 is a side plan view of the block shown in FIG. 13.

With the understanding that the block of the invention may be used in any number of structural configurations, an additional view of the protrusion of the invention may be seen in FIG. 15 in accordance with a preferred aspect of the invention. As can be seen, protrusion 26 generally has visible three sidewalls, 26A and 26B which are adjoined by 26C, in this view. In this instance, protrusion 26 sidewall 26B is a position towards the block back 18 and is angled so as to provide an adequate stopping or nesting mechanism to prevent any block, placed immediately adjacent it, from moving forward when stacked in an interlocking form, i.e. by interlocking the protrusion of one block with the insets of an immediately adjacent second block.

Further, by changing the incline of protrusion surface 26A so as to lessen the angle between the upper surface 10 of the block and protrusion surface 26A (or away from vertical), the protrusion may be formed more easily during block molding. Reducing the angle of surface 26A from vertical allows the application and release of the heated stripper shoe in a manner which lowers the potential for retaining fill within the heated stripper shoe indentation, (see FIG. 17A at 79). Hereagain, the positioning of protrusion surfaces 26A and 26B may depend upon how the block is to be used, with protrusion surface 26B positioned to resist the forward movement of subsequent courses of blocks and surface 26A positioned to facilitate manufacture of the block but not compromise the structural integrity of, for example, the resulting wall.

The protrusion 26 preferrably may also span the portion of the topside 10 of the block between inset 22A and 22B. In this instance, protrusion walls 26C run a distance C as can be seen in FIGS. 13 and 14. Hereagain, protrusion 26 sidewalls 26C may comprise any angle in relationship to vertical which benefits ease of manufacture and the structural integrity of any structure made from the block of the invention.

Extending the protrusion 26 across the top side 10 of a portion of the block also benefits manufacture. Generally, in the molding of the block of the invention, the mold will be filled with composite mix to the intended volume. The heated stripper shoe will then descend upon the fill, compressing the fill, and forming the block of the invention. At the same time, the heated stripper shoe will form protrusion 26 through complementary patterning in indentation 79 in the underside of the heated stripper shoe (see FIG. 17A) to form protrusion 26.

By extending the protrusion 26 from inset 22A through inset 22B an opening is created on either side of the shoe, at the heated stripper shoe outer edge which spans the width of the shoe. When fill is incidentally retained within the indentation 79 used to form the protrusion 26, it may be effectively removed by automated means such as a brush, scrapper, and the like. The exposure of the indentation 79 to the outer edge of the heated stripper shoe allows a brush to be run across the undersurface of the heated stripper shoe plate to dislodge any fill which has inadvertently found placement in this area.

Figure 16:
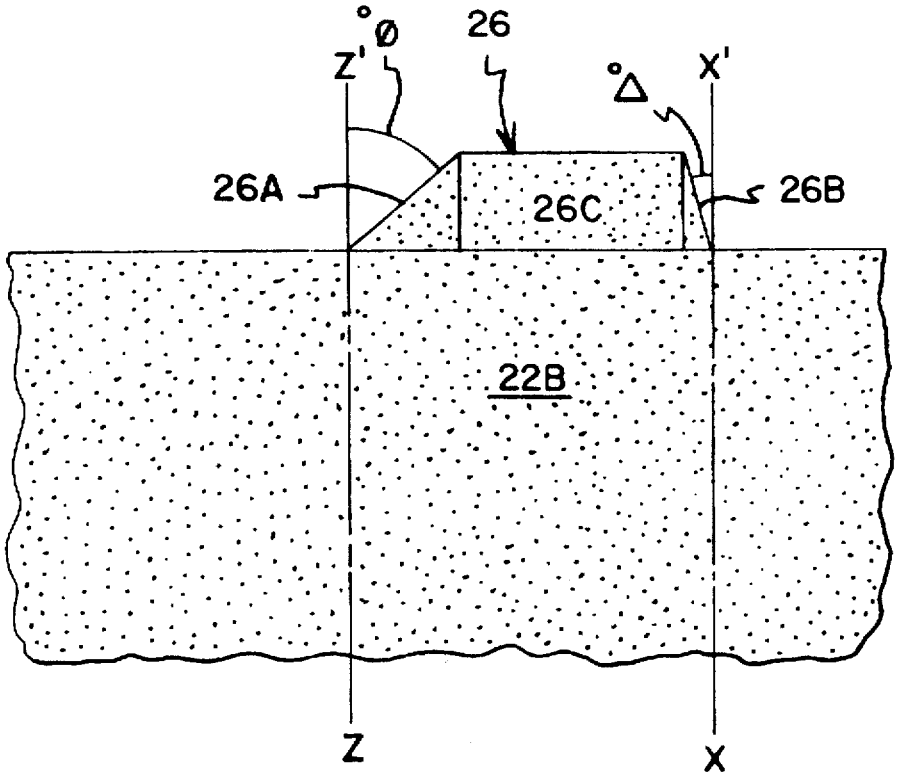
FIG. 16 is an enlarged side plan view of the block depicted in FIG. 15 showing, in detail, aspects of protrusion 26.

In accordance with a more preferred mode of the invention, FIG. 16 shows an enlarged cross-sectional view of protrusion 26. As can be seen in FIG. 16, protrusion surface 26B generally has an angle delta in relationship to vertical as shown by axis x-x'. In order to provide the greatest resistance towards displacement of a block on an adjacent course, angle delta generally ranges from about 0–10 degrees from vertical, preferably about 2–7 degrees from vertical, and most preferably about 5 degrees from vertical.

Further, in order to ease manufacture, protrusion surface 26A will generally have an angle theta which allows ease of manufacture which prevents fill from adhering from the underside of the heated stripper shoe. Generally, angle theta may range from 10 to 25 degrees from vertical, preferably from about 15 to 22 degrees from vertical, and preferably about 20 degrees from vertical as represented by access z-z', FIG. 16.

Hereagain, as one of skill in the art will realize from reading this application, the orientation of protrusion surfaces 26A and 26B may vary depending upon the structure of the block in the manner in which the block is used in, in overall landscape structure. Generally, surface 26B will preferably be used in order to retain blocks of adjacent courses in place and against forward movement resulting from the physical pressure created by fill loaded behind the structure. Further, protrusion surface 26A will generally be positioned in a non-retaining area of the protrusion so as to facilitate ease and manufacture. As noted earlier, protrusion surface 26C may range in angle from vertical to those limitations put forth for protrusion surface 26A. Generally, the angle of protrusion surface 26C should be adjusted to maintain the structural integrity of the block, provide the maximum resistive forces to blocks of adjacing courses, and provide ease in manufacturing.

In use, protrusion 26 may span from inset 22A to inset 22B across a portion of the top surface of the block. Generally, and according to this aspect of the invention, as shown in FIGS. 13–16 the protrusion will have a height ranging from one-quarter inch to three-quarter inches and preferably from about three-eighth inches to one-half inches. The overall width of the protrusion from surface 26A to 26B will generally range from about 1 inch to 4 inches, preferably about 2 to 3 inches, and most preferably about 2½ inches between protrusion surface 26A and 26B. Hereagain, one of skill in the art will understand, having read this specification, how these ranges may be changed or otherwise altered, but still within the scope of the invention.

While all of the blocks depicted herein may be made in varying scales, the following table provides general guidelines on size.

TABLE 1

| | General | Preferred | Most Preferred |
|---|---|---|---|
| BLOCKS OF FIGS. 1–6 | | | |
| front to back | 12–30" | 15–28" | 20–25" |
| top to bottom | 4–12" | 5–10" | 6–10" |
| side to side* | 12–30" | 15–25" | 15–20" |
| BLOCK OF FIG. 9 | | | |
| front to back | 6–24" | 8–15" | 10–12" |
| top to bottom | 4–12" | 5–10" | 6–10" |
| side to side* | 12–30" | 15–25" | 15–20" |
| BLOCK OF FIGS. 10–11 and 13–16 | | | |
| front to back | 12–30" | 15–28" | 20–25" |
| top to bottom | 4–12" | 5–10" | 6–10" |
| side to side* | 12–30" | 15–25" | 15–20" |

*block at its greatest dimension on an axis perpendicular to front surface.

Block Structures

Figure 7A:
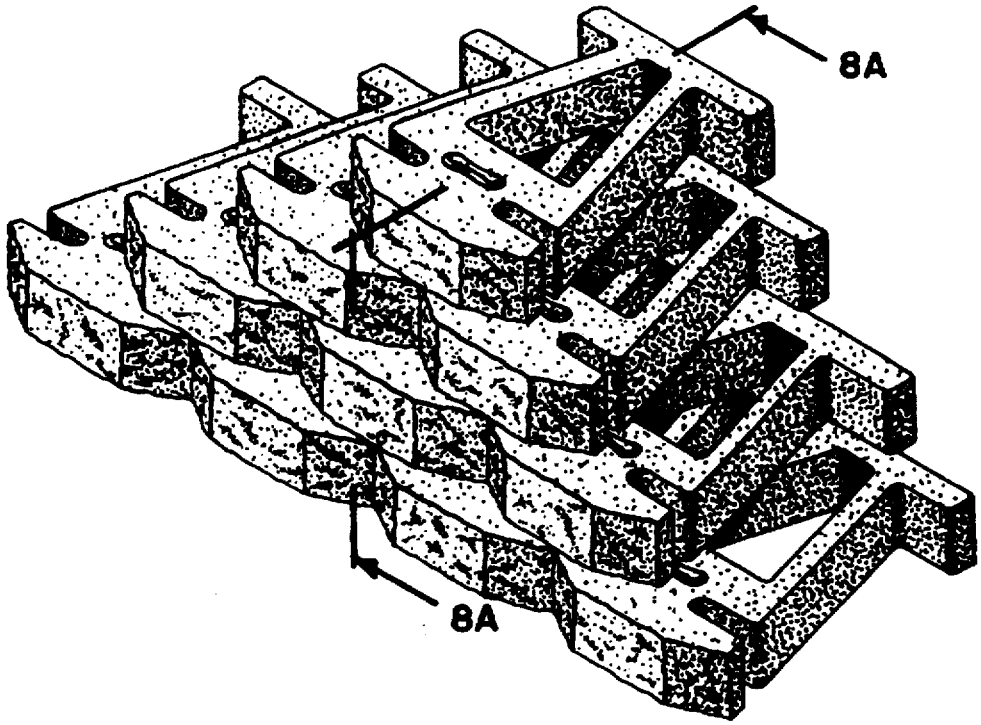
FIG. 7A is a perspective view of an alternative embodiment of a retaining structure constructed with one embodiment of the block of the invention.
Figure 8A:
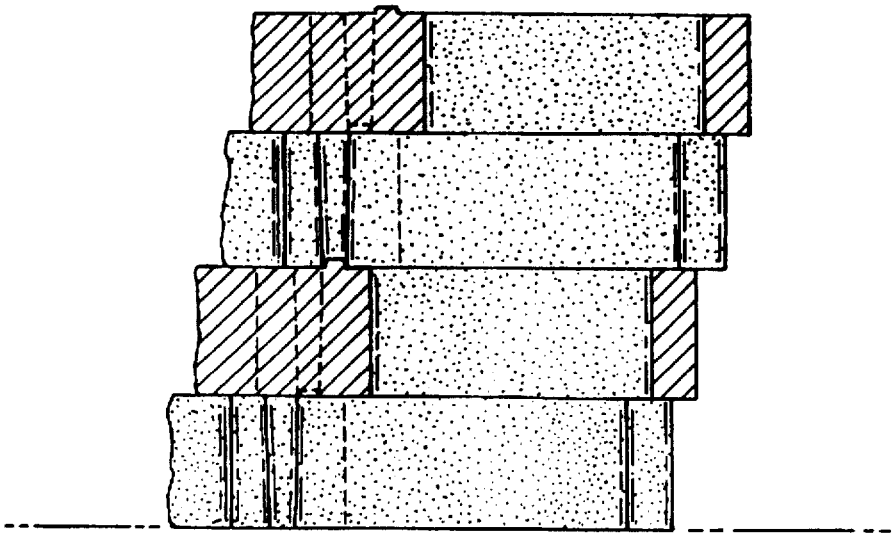
FIG. 8A is a cut away view of the wall shown in FIG. 7A as showing a wall which sets back taken along lines 8A—8A.

The composite masonry block 5 of the invention may be used to build any number of landscape structures. Examples of the structures which may be constructed with the block of the present invention are seen in FIGS. 7–8. As can be seen in FIG. 7, the composite masonry block of the invention may be used to build a retaining wall 10 using individual courses or rows of blocks to construct a wall to any desired height.

Generally, construction of a structure such as a retaining wall 10 may be undertaken by first defining a trench area beneath the plane of the ground in which to deposit the first course of blocks. Once defined, the trench is partially refilled and tamped or flattened. The first course of blocks is then laid into the trench. Successive courses of blocks are then stacked on top of preceding courses while backfilling the wall with soil.

The blocks of the present invention also allow for the production of serpentine walls. The blocks may be placed at an angle in relationship to one another so as to provide a serpentine pattern having convex and concave surfaces. If the desired structure is to be inwardly curving, blocks of the invention may be positioned adjacent each other by reducing either surface 28A or 28B on one or both blocks. Such a reduction may be completed by striking leg 24A or 24B with a chisel adjacent deflection 19, see FIGS. 1 and 4. Deflection 19 is preferably positioned on the block back surface 18 to allow reduction of the appropriate back surface leg (24A or 24B) while retaining enough potential open area for filling between blocks. Structures made from composite masonry blocks are disclosed in commonly assigned U.S. Pat. No. 5,062,610 which is incorporated herein by reference.

While designed for use without supporting devices, a supporting matrix may be used to anchor the blocks in the earth fill behind the wall. One advantage of the block of the invention is that despite the absence of pins, the distortion created by the block protrusions 26 when mated with insets 22A or 22B anchors the matrix when pressed between two adjacent blocks of different courses.

Figure 12:
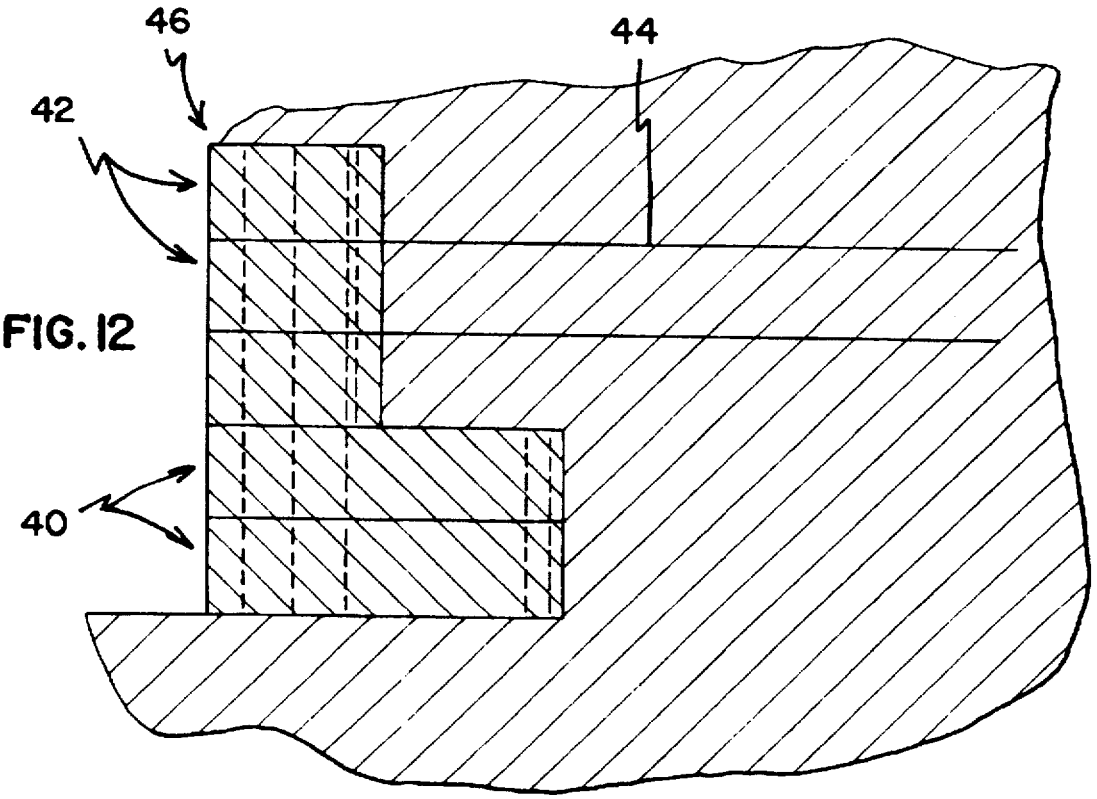
FIG. 12 is a cutaway view of a retaining structure constructed with the blocks depicted in FIGS. 9 and 10.

Further, the complementary design of the blocks of the invention allow the use of blocks 40 such as those depicted in FIGS. 1–6 and 10–11 with blocks 42 which are shorter in length in the construction retaining wall structures, (FIG. 12). Tie-backs, deadheads, and web matrices 44 may all be used to secure the retaining wall structure 46 in place. The generally large pound per square-foot front area of the blocks depicted herein allows blocks such as those depicted in FIGS. 1–6 and 10–11 to be used in the base courses with blocks such as those depicted in FIG. 9 used in the upper courses. In turn, the design of all the blocks disclosed herein allows the use retaining means such as geometric matrices (i.e., webs), deadheads and tie backs without pins. Such securing means may be useful in anchoring the smaller blocks in place when used, for example, towards the upper portion of the retaining structure.

The Stripper Shoe/Mold Assembly

The invention also comprises a heated stripper shoe, a heated stripper shoe/mold assembly and a method of forming concrete masonry blocks with the shoe and mold assembly.

Figure 17A:
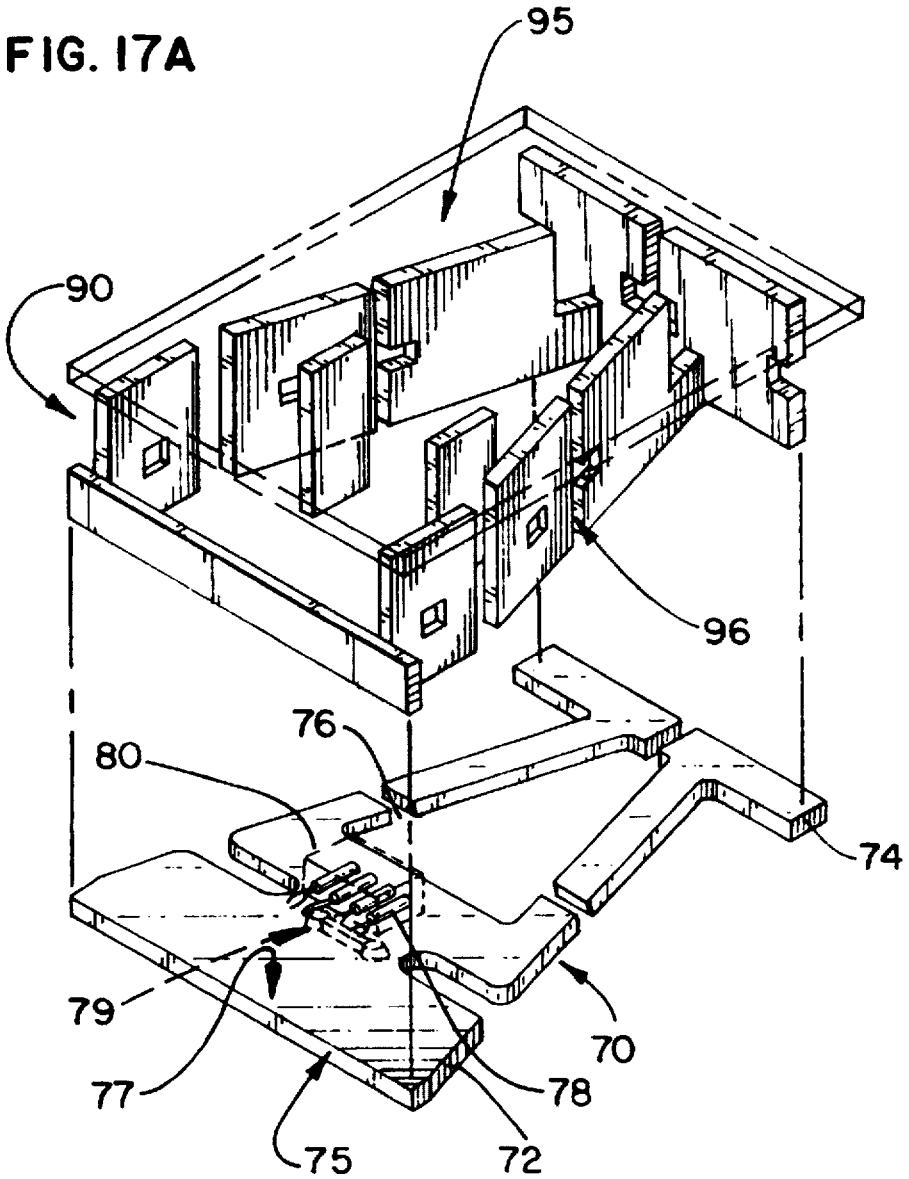
FIG. 17A is an exploded perspective view of the stripper shoe and head assembly of the invention.

The stripper shoe and mold assembly generally includes a stripper shoe plate 70, having a lower side 75 and an upper side 77, FIG. 17A. The stripper shoe plate 70 may have indentations to form block details such as those shown at 79 on the shoe lower side 75, (see also 26 at FIGS. 1 and 4). Heat elements 78 may be positioned on the stripper shoe plate upper side 77.

Positioned over the heat elements 78 on the upper surface of the shoe plate is a heat shroud 80 (shown in outline). The heat shroud lower side is configured to cover the heat elements 78. Once the heat shroud 80 is positioned over the upper surface 85 of the stripper shoe plate 70 wiring for the heat elements 78 may be passed through the heat shroud 80 and further into the head assembly.

The assembly may also comprise a standoff 90 which attaches the assembly to the block machine head 95. The standoff 90 is capable of spacing the stripper shoe plate 70 appropriately in the block machine and insulating the head from the heat developed at the surface of the stripper shoe plate 70.

The assembly also comprises a mold 50 having an interior perimeter designed to complement the outer perimeter of the stripper shoe plate 70. The mold generally has an open center 63 bordered by the mold walls.

Positioned beneath the mold is a pallet (not shown) used to contain the concrete fill in the mold and transport finished blocks from the molding machine.

The stripper shoe 70 serves as a substrate on which the heat elements 78 are contained. Further, the stripper shoe plate 70 also functions to form the body of the block as well as detail in the blocks through indentations 79 in the stripper shoe lower surface 75. In use, the stripper shoe 70 functions to compress fill positioned in the mold and, once formed, push or strip the block from the mold 50.

The stripper shoe plate 70 may take any number of designs or forms including ornamentation or structural features consistent with the block to be formed within the mold. Any number of steel alloys may be used in fabrication of the stripper shoe as long as these steel alloys have sufficient resilience and hardness to resist abrasives often used in concrete fill. Preferably, the stripper shoe 70 is made from steel alloys which will resist continued compression and maintain machine tolerances while also transmitting heat from the heat elements through the plate 70 to the fill. In this manner, the total thermal effect of the heat elements is realized within the concrete mix.

Preferably, the stripper shoe plate 70 is made from a carbonized steel which may further be heat treated after forging. Preferred metals include steel alloys having a Rockwell "C"-Scale rating from about 60–65 which provide optimal wear resistance and the preferred rigidity. Generally, metals also found useful include high grade carbon steel of 41-40 AISI (high nickel content, prehardened steel), carbon steel 40-50 (having added nickel) and the like. A preferred material includes carbon steel having a structural ASTM of A36. Preferred steels also include A513 or A500 tubing, ASTM 42-40 (prehardened on a Rockwell C Scale to 20 thousandths of an inch). The stripper shoe plate 70 may be formed and attached to the head assembly by any number of processes known to those of skill in the art including the nut, washer, and bolt mechanisms known to those of skill in the art.

One preferred heated stripper shoe design which complements the block mold is shown in FIG. 13B. The stripper shoe comprises a first section 72 and a second section 74, with the first section 74 having indentations 79 on the shoe lower side 75. A heat element 78 is positioned over indentation 79. The outer perimeter of the stripper shoe 70 may generally complement the interior outline of the mold 50. Heat elements 78 are preferably positioned adjacent to indentation 79 on the shoe lower side 75 to facilitate the formation of that point of detail created by the indentations 79 in the stripper shoe 70. While generally shown with one form of indentation 79, the stripper shoe plate 70 may be capable of forming any number of designs through indentations in the shoe plate lower surface 75 depending on the nature of the block to be formed.

The invention may also comprise one or more heat elements 78. Generally, the heat element 78 functions to generate and transmit radiant energy to the upper surface 77 of the stripper shoe 70. The heat elements are preferably positioned adjacent indentation 79 in the shoe plate lower surface 75.

Generally, any type and quantity of heat elements 78 may be used in accordance with the invention. However, preferred heat elements have been found to be those which will withstand the heavy vibration, dirt and dust common in this environment. Preferred heat elements are those which are easily introduced and removed from the system. This allows for easy servicing of the stripper shoe assembly without concerns for injury to the operator through thermal exposure or complete disassembly of mold 50, stripper shoe 70, shroud 80, and standoff 90.

The heat element may comprise any number of electrical resistance elements which may be, for example, hard wired, solid state, or semiconductor circuitry, among others. The heat element 78 may generally be positioned over indentations 79 in the stripper shoe lower surface 75, FIG. 13A. By this positioning, the heat element 78 is able to apply heat to the stripper shoe 70 in the area where it is most needed, that is, where the block detail (in this case, protrusion 26, see FIG. 1) is formed in the concrete mix held by the mold.

The heat element 78 may comprise any number of commercially available elements. Generally, the power provided by the heat element may range anywhere from 300 watts up to that required by the given application. Preferably, the power requirements of the heat element may range from about 400 watts to 1500 watts, more preferably 450 watts to 750 watts, and most preferably about 600 watts. Power may be provided to the heat elements by any number of power sources including for example, 110 volt sources equipped with 20 to 25 amp circuit breakers which allow the assembly to run off of normal residential current. If available, the assembly may also run off of power sources such as 3-phase, 220 volt sources equipped with 50 amp circuit breakers or other power sources known to those of skill in the art. However, the otherwise low power requirements of the assembly allow use in any environment with minimal power supplies.

Elements found useful in the invention include cartridge heaters, available from Vulcan Electric Company, through distributor such as Granger Industrial Co. of Minnesota. These elements have all been found to provide easy assembly and disassembly in the stripper shoe of the invention as well as good tolerance to vibration, dirt, dust, and other stresses encountered in such an environment.

Generally, the heat elements may be activated by hard wiring as well as any other variety of electrical feeds known to those of skill in the art. If hard wiring is used, provision may be made to circulate this wiring through the shroud 80 and standoff 90 by various openings 88. The heat element 78 may be externally controlled through any number of digital or analogue mechanisms known to those of skill in the art located at an external point on the block machine.

Heating the stripper shoe elements 78 allows the formation of block detail such as indentations or protrusions, or combinations thereof without the fouling of the shoe plate 70. Detail is essentially formed by case hardening the concrete fill adjacent the element 78. This allows the formation of block detail which is both ornate and has a high degree of structural integrity.

The invention may also comprise means of attaching the heat element 78 to the stripper shoe 70 such as a heat block. Examples of attachment means for the heat elements 76 may be seen in commonly assigned U.S. patent application No. 07/828,031, filed Jan. 30, 1992, which is incorporated herein by reference.

The stripper shoe may also comprise a heat shroud 80 (shown in outline), FIG. 17A, which thermally shields or insulates the heat elements 78 and molding machine. The heat shroud 80 also functions to focus the heat generated by the heat elements 78 back onto the stripper shoe 70.

The heat shroud 80 may take any number of shapes of varying size in accordance with the invention. The heat shroud 80 should preferably contain the heat elements 78. To this end, the heat shroud 80 preferably has a void formed within its volume so that it may be placed over the heat elements 78 positioned on the upper surface 77 of the stripper shoe 70. At the same time, the shroud 80 is preferably positioned flush with the stripper shoe upper surface 77.

Preferably, there is a space between the upper surface of the heat element and the opening or void in the heat shroud 80. Air in this additional space also serves to insulate the standoff and mold machine from the heat created by the heat element 78.

Generally, the heat shroud 80 may comprise any metal alloy insulative to heat or which is a poor conductor of thermal energy. Metal alloys such as brass, copper, or composites thereof are all useful in forming the heat shroud 80. Also useful are aluminum and its oxides and alloys. Alloys and oxides of aluminum are preferred in the formation of the heat shroud 80 due to the ready commercial availability of these compounds. Aluminum alloys having an ASTM rating of 6061-T6 and 6063-T52 are generally preferred over elemental aluminum.

The assembly may additionally comprise a head standoff 90, attached to the stripper shoe plate 70, to position, aid in compression, and attach the head assembly to the block machine.

Generally, the head standoff 90 may comprise any number of designs to assist and serve this purpose. The head standoff may also be used to contain and store various wiring or other elements of the stripper shoe assembly which are not easily housed either on the stripper shoe 70, or the heat shroud 80.

The head standoff 90 may comprise any number of metal alloys which will withstand the environmental stresses of block molded processes. Preferred metals include steel alloys having a Rockwell "C"-Scale rating from about 60–65 which provide optimal wear resistance and the preferred rigidity.

Generally, metals found useful in the manufacture of the head standoff mold of the present invention include high grade carbon steel of 41-40 AISI (high nickel content, prehardened steel), carbon steel 40-50 (having added nickel) and the like. A preferred material includes carbon steel having a structural ASTM of A36. Generally, the head standoff 50 may be made through any number of mechanisms known to those of skill in the art.

The assembly may also comprise a mold 50. The mold generally functions to facilitate the formation of the blocks. Accordingly, the mold may comprise any material which will withstand the pressure to be applied to the block filled by the head. Preferably, metal such as steel alloys having a Rockwell "C"-Scale rating from about 60–65 which provide optimal wear resistance and the preferred rigidity.

Generally, other metals found useful in the manufacture of the mold of the present invention include high grade carbon steel of 41-40 AISI (high nickel content, prehardened steel), carbon steel 40-50 (having added nickel) and the like. A preferred material includes carbon steel having a structural ASTM of A36.

Mold 50 useful in the invention may take any number of shapes depending on the shape of the block to be formed and be made by any number of means known to those of skill in the art. Generally, the mold is produced by cutting the steel stock, patterning the cut steel, providing an initial weld to the pattern mold pieces and heat treating the mold. Heat treating generally may take place at temperatures ranging from about 1000° F. to about 1400° F. from 4 to 10 hours depending on the ability of the steel to withstand processing and not distort or warp. After heat treating, final welds are then applied to the pieces of the mold.

Turning to the individual elements of the mold, the mold walls generally function according to their form by withstanding the pressure created by the block machine. Further, the walls measure the height and the depth of resulting blocks. The mold walls must be made of a thickness which will accommodate the processing parameters of the block formation given a specific mold composition.

Figure 17B:
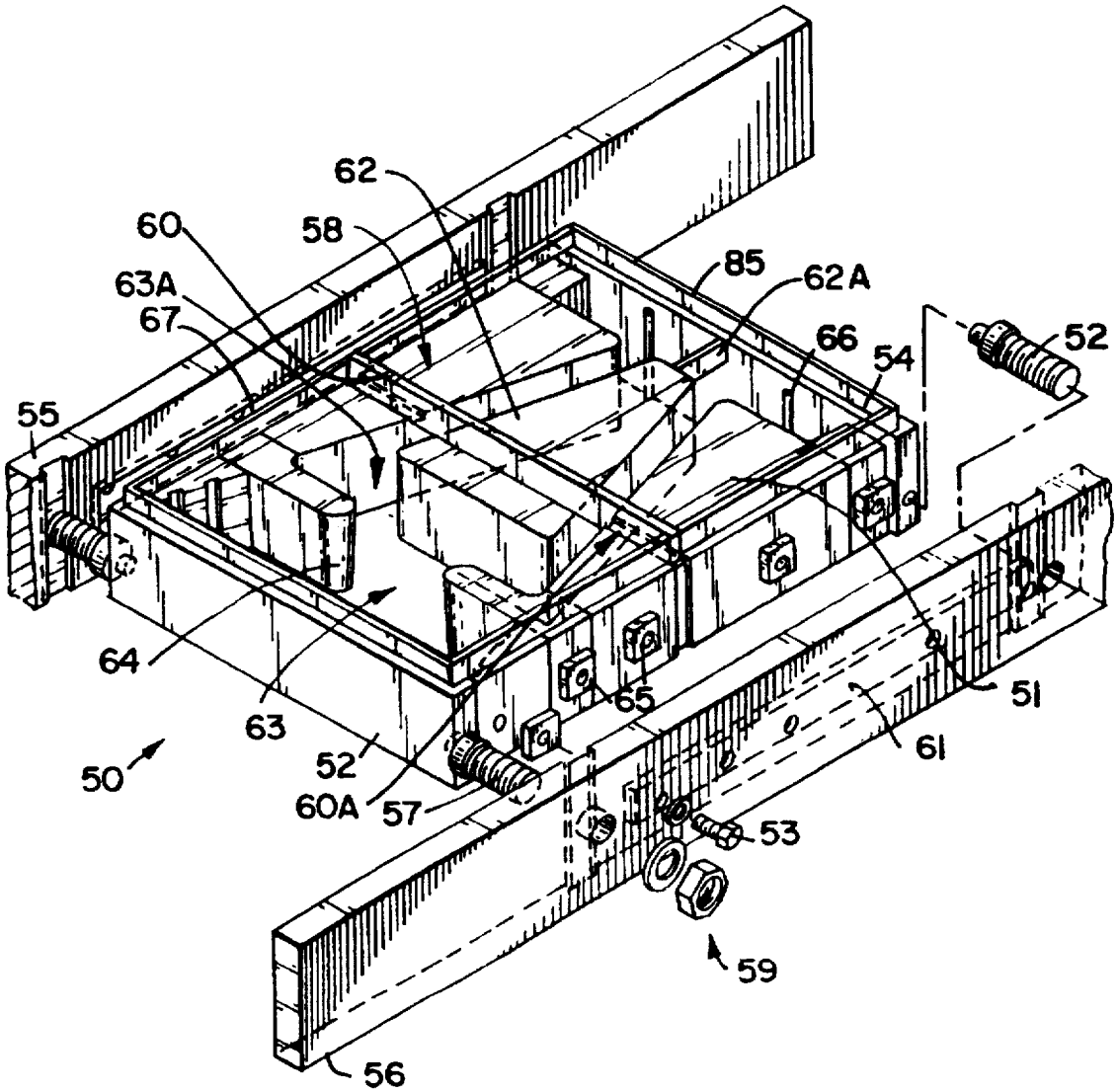
FIG. 17B is perspective view of the mold assembly of the invention.

Generally, as can be seen in FIG. 17B, the mold comprises a front surface 52, back surface 54, as well as a first side surface 51, and a second side surface 58. As noted, each of these surfaces function to hold fill within a contained area during compression, thus resulting in the formation of a block. Accordingly, each of these mold surfaces may take a shape consistent with this function.

The mold side walls, 51 and 58, may also take any shape in accordance with the function of the mold. Preferably, the side walls each comprise an extension 64 which are useful in forming the insets 22A and 22B in the block of the invention, see FIG. 1. In order to form insets 22A and 22B in the block of the invention, extension 64 may have a dimension which is fairly regular over the depth of the mold.

Figure 4:
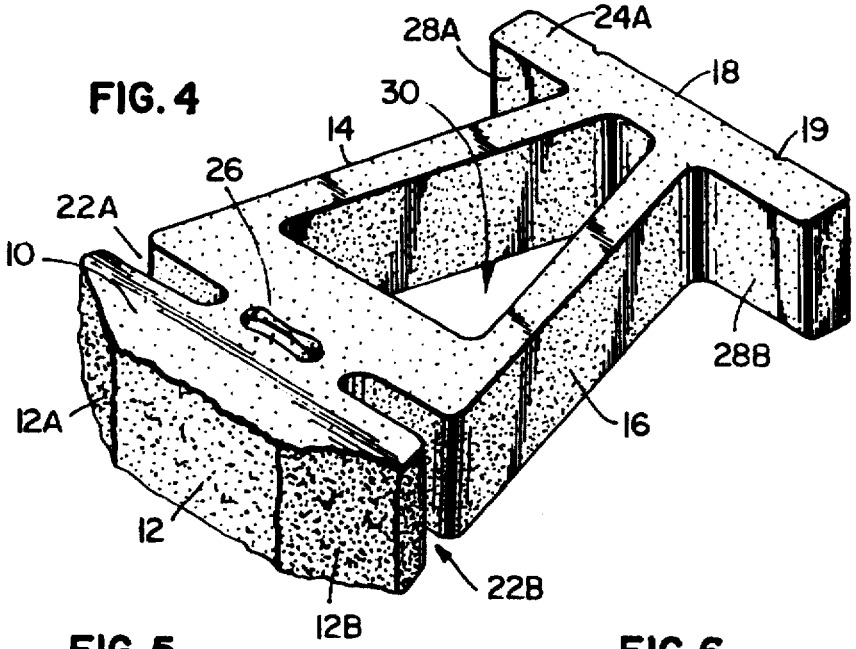
FIG. 4 is a perspective view of an alternative preferred embodiment of the block in accordance with the invention.
Figure 5:
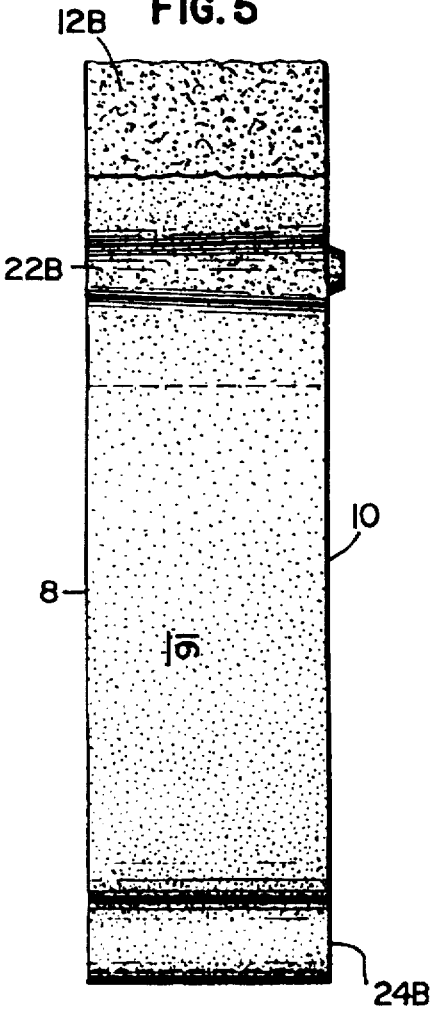
FIG. 5 is a side plan view of the block of FIG. 4.

However, if insets 22A and 22B are required which have a conical shape as seen in FIGS. 2 and 5, the extensions may be formed to have a width at the top of the mold which is greater than the width of the extension at the bottom of the mold. This will result in the insets 22A and 22B which are seen in the various embodiments of the block of the invention shown in FIGS. 1–6 as well as FIGS. 9–11 while also allowing stripping of the block from the mold 50 during processing.

The mold may preferably also comprise one or more support bars 60 and core forms 62. The support bars 60 hold the core forms 62 in place within the mold cavity 63. Here again, the support bars may take any shape, size, or material composition which provides for these functions.

As can be seen more clearly in FIG. 17B, support bar 60 is preferably long enough to span the width of the mold 50 resting on opposing side walls 51 and 59. The support bar 60 functions to hold the core 62 within the mold central opening 63. Complementing this function, the support bar 60 is generally positioned in the central area 63A of the opposing side walls 51 and 58. The core form 62 may also be held in place by an additional support 62A (shown in outline) placed between the back wall 54 of the mold 50 and the core form 62. Support bar 60 may also be held in place by a bracket 85 affixed above and around the outer perimeter of the mold 50 at the edges of walls 51, 52, 58, and 54. The use of these various support structures reduces core form vibration during the molding process.

As can be seen in the outline on FIG. 17B, the core form 62 are supported by bar 60 which span the width of the mold 50 resting on the opposing side walls 51 and 58. The core forms have any number of functions. The core forms 62 act to form voids in the resulting composite masonry block. In turn, the core forms lighten the blocks, reduce the amount of fill necessary to make a block, and add to the portability and handleability of the blocks to assist in transport and placement of the blocks.

Also preferred as can be seen in the view provided in FIG. 13B, the core form 62 is affixed to the support bar 60 at insert regions 60A. These insert regions 60A assist in positioning the core forms. As can be seen, the support bar 60 projects upwards from mold 50. As a result, the stripper shoe 70 and stand off 80 may be partitioned or split as can be seen by openings 76 and 96, respectively (FIG. 17A). The separate sections of the shoe 70 and stand off will allow adequate compression of the fill without obstruction by the support bar 60. In turn, the various sections of the stripper shoe 70 and stand off 90 may be held in place by the head 95.

While the mold of the invention may be assembled through any number of means, one manner is that shown in FIG. 17B. Preferably, the mold is held in place by two outer beams 55 and 56, each of which have an interior indentation, 61 and 67 respectively. As can be seen, bolt elements 57 may be fit into the front wall 52 and back wall 54 of the mold 50. The side walls 51 and 58 of the mold may be held in the outer beams of the mold by nut plates 65 sized to fit in indentations 61 and 67. In turn the nut plates 65 may be held within the outer beam indentations 61 by bolt means 53. In this manner, the mold 50 may be held in place even though constructed of a number of pieces.

Block Molding

Figure 18:
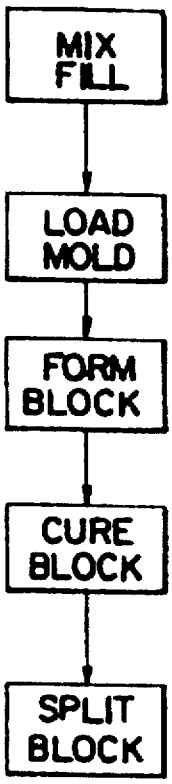
FIG. 18 is a schematic depiction of the molding process of the invention.

An additional aspect of the present invention is the process for casting or forming the composite masonry blocks of this invention using a masonry block mold assembly, FIGS. 13A and 13B. Generally, the process for making this invention includes block molding the composite masonry block by filling a block mold with mix and casting the block by compressing the mix in the mold through the application of pressure to the exposed mix at the open upper end of the block mold. An outline of the process can be seen in the flow chart shown in FIG. 18.

In operation, the assembly is generally positioned in the block molding machine atop of a removable or slidable pallet (not shown). The mold 50 is then loaded with block mix or fill. As configured in FIGS. 17A and 17B, the mold 50 is set to form one block. Once formed and cured, these blocks may be split along the deflections created by flanges 66 which may be positioned on the interior of sidewalls of the mold. Prior to compression, the upper surface of the mold is vibrated to settle the fill and scraped or raked with the feed box drawer (not shown) to remove any excess fill. The mold is then subjected to compression directly by the stripper shoe 70 through head assembly.

Upon compression, the stripper shoe 70 forces block fill towards either end of the mold and into the stripper shoe indentation 79 to create a protrusion 26 in the formed block, see FIG. 1. This indentation may range in size for example from about 1 to 3 inches, preferably about 1½ to 2½ inches, and most preferably about 1¾ to 2 inches.

In accordance with the invention, this indentation 79 is heated by elements 78 so that protrusions 26 of minimal size and varying shape may be formed without the build up of fill on the stripper shoe 70 at indentation 79. By doing so, the assembly may be used in the automatic manufacture of blocks by machine.

Blocks may be designed around any number of different physical properties in accordance with ASTM Standards depending upon the ultimate application for the block. For example, the fill may comprise from 75 to 95% aggregate being sand and gravel in varying ratios depending upon the physical characteristics which the finished block is intended to exhibit. The fill generally also comprises some type of cement at a concentration ranging from 4% to 10%. Other constituents may then be added to the fill at various trace levels in order to provide blocks having the intended physical characteristics.

Generally, once determined the fill constituents may be mixed by combining the aggregate, the sand and rock in the mixer followed by the cement. After one to two and one-half minutes, any plasticizers that will be used are added. Water is then introduced into the fill in pulses over a one to two minute period. The concentration of water in the mix may be monitored electrically by noting the electrical resistance of the mix at various times during the process. While the amount of water may vary from one fill formulation to another fill formulation, it generally ranges from about 1% to about 6%.

Once the mold has been filled, leveled by means such as a feed box drawer, and agitated, a compression mechanism such as a head carrying the inventive assembly converges on the exposed surface of the fill. The stripper shoe assembly 30 acts to compress the fill within the mold for a period of time sufficient to form a solid contiguous product. Generally, the compression time may be anywhere from 0.5 to 4 seconds and more preferably about 1.5 to 2 seconds. The compression pressure applied to the head ranges from about 1000 to about 8000 psi and preferably is about 4000 psi.

Once the compression period is over, the stripper shoe 70 in combination with the underlying pallet acts to strip the blocks from the mold 50. At this point in time the blocks are formed. Any block machine known to those of skill in the art may be used in accordance with the invention. One machine which has been found useful in the formation of blocks is a Besser V-3/12 block machine.

Generally, during or prior to compression the mold may be vibrated. The fill is transported from the mixer to a hopper which then fills the mold 50. The mold is then agitated for up to 2 to 3 seconds, the time necessary to ensure the fill has uniformly spread throughout the mold. The blocks are then formed by compressive action by the compressive action the head. Additionally, this vibrating may occur in concert with the compressive action of the head onto the fill in the mold. At this time, the mold will be vibrated for the time in which the head is compressed onto the fill.

Once the blocks are formed, they may be cured through any means known to those with skill in the art. Curing mechanisms such as simple air curing, autoclaving, steam curing or mist curing, are all useful methods of curing the block of the present invention. Air curing simply entails placing the blocks in an environment where they will be cured by open air over time. Autoclaving entails placing the blocks in a pressurized chamber at an elevated temperature for a certain period of time. The pressure in the chamber is then increased by creating a steady mist in the chamber. After curing is complete, the pressure is released from the chamber which in turns draws the moisture from the blocks.

Another means for curing blocks is by steam. The chamber temperature is slowly increased over two to three hours and then stabilized during the fourth hour. The steam is gradually shut down and the blocks are held at the eventual temperature, generally around 120°–200° F. for two to three hours. The heat is then turned off and the blocks are allowed to cool. In all instances, the blocks are generally allowed to sit for 12 to 24 hours before being stacked or stored. Critical to curing operations is a slow increase in temperature. If the temperature is increased too quickly, the blocks may "case-harden". Case hardening occurs when the outer shell of the block hardens and cures while the inner region of the block remains uncured and moist. While any of these curing mechanisms will work, the preferred mechanism is autoclaving.

Figure 6:
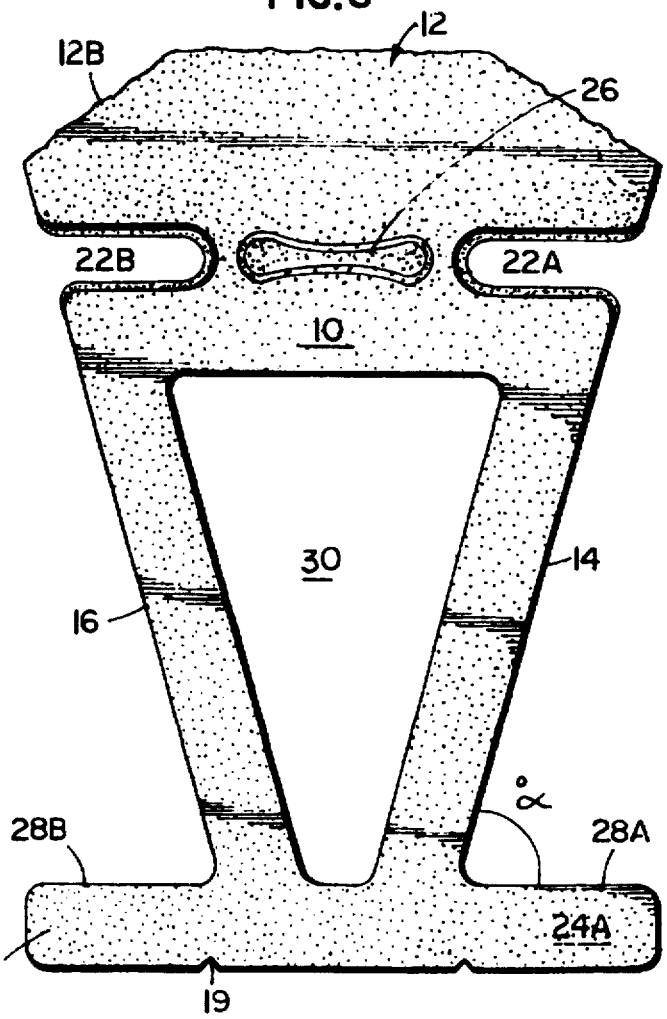
FIG. 6 is a top plan view of the block of FIG. 4.

Once cured the blocks may be split to create any number of functional or aesthetic features in the blocks. Splitting means which may be used in the invention include manual chisel and hammer as well as machines known to those with skill in the art. Flanges 66 (FIG. 9) may be positioned on the interior of the mold 50 side walls to provide a natural weak point or fault which facilitates the splitting action. The blocks may be split in a manner which provides a front surface 12 which is smooth or coarse (FIGS. 1–6 and FIGS. 9–11), single faceted (FIG. 1) or multifaceted (FIG. 4), as well as planar or curved. For example, the blocks may be split to provide a faceted front surface as shown in FIGS. 4–6 by surfaces 12A, 12, and 12B. Preferably, splitting will be completed by an automatic hydraulic splitter. When split, the blocks may be cubed and stored. Once split, the blocks may be cubed and stored.

The above discussion, examples, and embodiments illustrate our current understanding of the invention. However, since many variations of the invention can be made without departing from the spirit and scope of the invention, the invention resides wholly in the claims hereafter appended.

We claim as our invention:

1. A retaining wall block comprising:

a front portion including a decorative front surface;

a tail portion including a rear surface;

a pair of opposed sides extending from the front surface to the tail portion and converging toward the tail portion;

opposed top and bottom surfaces;

one or more locator protrusions integrally formed on the top or bottom surface, each locator protrusion comprising at least one curved side surface; and one or more locator walls formed in said block, each locator wall extending from the top surface of the block to the bottom surface of the block, and each locator wall being adapted to mate with the curved side surface of a locator protrusion on a block in an adjacent course, when a plurality of said blocks are stacked in courses to form a wall structure.

2. The block of claim 1 wherein said block front portion is substantially planar.

3. The block of claim 1 wherein said block front portion is faceted.

4. The block of claim 1 wherein said block front portion is outwardly curving.

5. The block of claim 1 wherein at least one of said locator protrusions is positioned adjacent at least one of said block locator walls.

6. The block of claim 1, wherein said block comprises first and second locator protrusions, said first locator protrusion being located adjacent one of said opposed sides and said second locator protrusion being located adjacent the other of said opposed sides.

7. The block of claim 1, wherein said locator protrusion is configured to mate with a curved locator wall on an adjacently positioned block.

8. The block of claim 6, wherein said block comprises at least two locator walls, said first locator protrusion being configured to mate with one of said locator walls on an adjacently positioned block, said second locator protrusion being configured to mate with another locator wall on an adjacently positioned block.

9. A structure resulting from two or more of the blocks of claim 1.

10. The structure of claim 9 wherein said one or more locator protrusions and said one or more block locator walls are configured to provide a set back in said structure.

11. The structure of claim 10 wherein said structure is a retaining wall.

12. A retaining wall block comprising:

a front portion including a decorative front surface;

a tail portion include a rear surface;

a pair of opposed sides extending from the front surface to the tail portion and converging toward the tail portion;

opposed top and bottom surfaces;

one or more locator protrusions integrally formed on the top or bottom surface, each locator protrusion comprising at least one curved side surface; and one or more locator walls formed in said block, each locator wall extending from the top surface of the block to the bottom surface of the block, and each locator wall being adapted to mate with the curved side surface of a locator protrusion on a block in an adjacent course, when a plurality of said blocks are stacked in courses to form a wall structure; and a first leg extending from one of said opposed sides and a second leg extending from the other of said opposed sides.

13. The block of claim 12 wherein said locator protrusion is configured to mate with a locator wall of an adjacently positioned block.

14. The block of claim 12, wherein said block comprises first and second locator protrusions, said first locator protrusion being located adjacent one of said opposed sides and said second locator protrusion being located adjacent the other of said opposed sides.

15. The block of claim 12, wherein said locator protrusion is configured to mate with a curved locator wall on an adjacently positioned block.

16. The block of claim 14, wherein said block comprises at least two locator walls, said first locator protrusion being configured to mate with one of said locator walls on an adjacently positioned block, said second locator protrusion being configured to mate with another locator wall on an adjacently positioned block.

17. The block of claim 12 wherein said first and second legs comprise front surfaces, said leg front surfaces being configured to extend towards said block front portion as said first and second legs extend away from said block.

18. The block of claim 12 wherein said block front portion is substantially planar.

19. The block of claim 12 wherein said block front portion is faceted.

20. The block of claim 12 wherein said block front portion is outwardly curving.

21. A structure resulting from two or more of the blocks of claim 12.

22. The structure of claim 21 wherein said one or more locator protrusions and said one or more block locator walls are configured to provide a set back in said structure.

23. The structure of claim 22 wherein said structure is a retaining wall.

24. A retaining structure, said retaining structure comprising one or more courses, each of said courses comprising one or more retaining wall blocks, each of said retaining wall blocks comprising:

a front portion including a decorative front surface;

a tail portion including a rear surface;

a pair of opposed sides extending from the front surface to the tail portion and converging toward the tail portion;

opposed top and bottom surfaces;

one or more locator protrusions integrally formed on the top and bottom surface, each locator protrusion comprising at least one curved side surface; and one or more locator walls formed in said block, each locator wall extending from the top surface of the block to the bottom surface of the block, and each locator wall being adapted to mate with the curved side surface of a locator protrusion on a block in an adjacent course, when a plurality of said blocks are stacked in courses to form a wall structure.

25. The structure of claim 24 wherein said structure comprises at least an upper and an adjacent lower course wherein the blocks of at least one of said upper course or said lower course comprise said locator walls which are seated on the locator protrusions of the blocks of said adjacent course.

26. The structure of claim 25 wherein said retaining structure comprises a supporting matrix positioned between adjacent blocks of said upper and lower courses.

27. The structure of claim 26 wherein said supporting matrix comprises a continuous webbing positioned between the blocks of said upper and lower courses.

28. A retaining wall block comprising:

a front portion including a decorative front surface;

a tail portion including a rear surface;

a pair of opposed sides extending from the front surface to the tail portion and converging toward the tail portion;

opposed top and bottom surfaces;

one or more locator protrusions integrally formed on the top or bottom surface;

at least one cavity extending from the top surface of the block to the bottom surface of the block; and one or more locator walls formed in said block, each locator wall extending from the top surface of the block to the bottom surface of the block, and each locator wall being adapted to mate with a locator protrusion on a block in an adjacent course, when a plurality of said blocks are stacked in courses to form a wall structure; and said one or more protrusions and said one or more locator walls having relative sizes and shapes adapted to permit relative rotation of the protrusion and the locator wall with which it is mated, whereby serpentine walls may be constructed from a plurality of such blocks.

29. The retaining wall block of claim 28 wherein the tail portion includes a first leg extending from one of said opposed sides and a second leg extending from the other of said opposed sides.

30. The retaining wall block of claim 29 wherein a portion of each of said legs is contiguous with the rear surface of the block.

* * * * *

UNITED STATES PATENT AND TRADEMARK OFFICE

CERTIFICATE OF CORRECTION

PATENT NO. : 5,709,062

DATED : JANUARY 20, 1998

INVENTOR(S) : WOOLFORD

It is certified that error appears in the above-identified patent and that said Letters Patent is hereby corrected as shown below:

Col. 19, line 47: "top and bottom" should read --top or bottom--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*

US005709062C1

(12) EX PARTE REEXAMINATION CERTIFICATE (5681st)

United States Patent
Woolford

(10) Number: US 5,709,062 C1
(45) Certificate Issued: Feb. 27, 2007

(54) COMPOSITE MASONRY BLOCK

(75) Inventor: Michael E. Woolford, Lake Elmo, MN (US)

(73) Assignee: Anchor Wall Systems, Inc., Brooklyn Park, MN (US)

Reexamination Request:
No. 90/007,238, Oct. 6, 2004

Reexamination Certificate for:

| | |
|---|---|
| Patent No.: | **5,709,062** |
| Issued: | **Jan. 20, 1998** |
| Appl. No.: | **08/680,919** |
| Filed: | **Jul. 15, 1996** |

Certificate of Correction issued Apr. 24, 2001.

Related U.S. Application Data

(63) Continuation of application No. 08/434,779, filed on May 4, 1995, now Pat. No. 5,711,129, which is a division of application No. 08/130,298, filed on Oct. 1, 1993, now abandoned, which is a continuation-in-part of application No. 08/056,986, filed on May 4, 1993, now abandoned, which is a continuation of application No. 07/957,598, filed on Oct. 6, 1992, now abandoned.

(51) Int. Cl.

| | |
|---|---|
| ***B28B 7/16*** | (2006.01) |
| ***B28B 7/00*** | (2006.01) |
| ***B28B 7/18*** | (2006.01) |
| ***B28B 7/42*** | (2006.01) |
| ***B28B 17/00*** | (2006.01) |
| ***B28B 7/10*** | (2006.01) |
| ***B28B 7/40*** | (2006.01) |
| ***E04C 1/00*** | (2006.01) |
| ***E04C 1/39*** | (2006.01) |
| ***E02D 29/02*** | (2006.01) |

(52) U.S. Cl. ..... 52/604; 52/592.6; 52/608; 52/611

(58) Field of Classification Search ..... None
See application file for complete search history.

(56) References Cited

U.S. PATENT DOCUMENTS

| | | | |
|---|---|---|---|
| D34,284 | S | 3/1901 | Jacquart |
| 2,149,957 | A | 3/1939 | Dawson |
| D201,966 | S | 8/1965 | Frese |
| 4,196,161 | A | 4/1980 | Toffolon et al. |
| D295,788 | S | 5/1988 | Forsberg |
| D297,464 | S | 8/1988 | Forsberg |
| D299,067 | S | 12/1988 | Forsberg |
| D301,064 | S | 5/1989 | Forsberg |
| 4,914,876 | A | 4/1990 | Forsberg |
| 4,920,712 | A | 5/1990 | Dean, Jr. |
| 4,964,761 | A | 10/1990 | Rossi |

FOREIGN PATENT DOCUMENTS

| | | |
|---|---|---|
| JP | 54-107105 | 7/1979 |
| JP | 54-107106 | 7/1979 |
| JP | 59-167842 | 11/1984 |

OTHER PUBLICATIONS

A document (1 page—labeled R001390) in Japanese and 5 pages (R001391–R001395) of purported English translation of the Japanese document; date uncertain.

Apr. 6, 2006 Decision Granting Petition, filed Aug. 11, 2005, to correct inventorship in U.S. Appl. No. 08/474,097, issued as U.S. Patent No. 5,795,105.

Apr. 6, 2006, Decision Granting Petition, filed Aug. 11, 2005, to correct inventorship in U.S. Appl. No. 09/131,084, issued as U.S. Patent No. 6,113,318.

*Primary Examiner*—Peter C. English

(57) ABSTRACT

A composite masonry block having a front surface and a back surface which are adjoined by first and second side surfaces, as well as a top surface and a bottom surface each lying adjacent the front, back, and first and second side surfaces. Each of the side surfaces has an inset spanning from the block top surface to the block bottom surface. The block top surface has one or more protrusions positioned adjacent the first and second insets on the block top surface. The blocks have back legs which are directed outwardly from the blocks back surface. The block back legs may extend in a plane parallel to the block front surface or extend

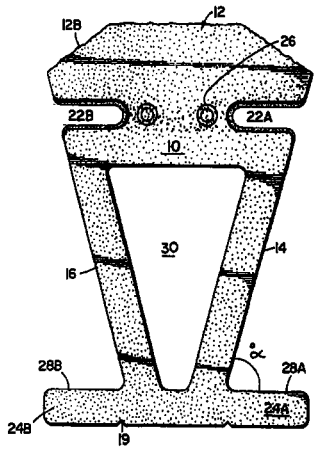

forwardly toward the blocks front surface. In use, the blocks may be stacked to provide an interlocking structure wherein the protrusions of one block interfit within the insets of another block. Also included is a method of block molding and a mold assembly which may be used to make a block which may be stackable to form structures of varying setback.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–30 is confirmed.

* * * * *